US006772910B1

(12) United States Patent
Coory

(10) Patent No.: US 6,772,910 B1
(45) Date of Patent: Aug. 10, 2004

(54) PIERCING CAP FOR A CONTAINER

(75) Inventor: Fredrick Michael Coory, 1 Dymock Place, Christchurch (NZ)

(73) Assignee: Fredrick Michael Coory, Christchurch (NZ)

( * ) Notice: Subject to any disclaimer, the term of this patent is extended or adjusted under 35 U.S.C. 154(b) by 0 days.

(21) Appl. No.: 10/130,817

(22) PCT Filed: Nov. 16, 2000

(86) PCT No.: PCT/NZ00/00229

§ 371 (c)(1),
(2), (4) Date: May 17, 2002

(87) PCT Pub. No.: WO01/36289

PCT Pub. Date: May 25, 2001

(30) Foreign Application Priority Data

| | | |
|---|---|---|
| Nov. 17, 1999 | (NZ) | 501177 |
| Dec. 21, 1999 | (NZ) | 501941 |
| Oct. 13, 2000 | (NZ) | 507516 |

(51) Int. Cl.[7] ..... B65D 47/10

(52) U.S. Cl. ..... 222/83; 222/153.05; 222/541.2; 222/541.6; 222/525

(58) Field of Search ..... 222/23, 153.05, 222/83, 83.5, 91, 541.2, 541.6, 559, 222, 525

(56) References Cited

U.S. PATENT DOCUMENTS

| | | | | |
|---|---|---|---|---|
| 2,859,898 A | | 11/1958 | Medenhall | |
| 3,347,410 A | | 10/1967 | Schwartzman | |
| 3,924,741 A | | 12/1975 | Kachur et al. | 206/221 |
| 4,516,691 A | * | 5/1985 | Christine et al. | 222/83.5 |
| 4,638,927 A | | 1/1987 | Morane | 222/83 |
| 4,779,764 A | * | 10/1988 | Debetencourt | 222/83 |
| 4,884,705 A | | 12/1989 | Debetencourt | |
| 4,982,875 A | | 1/1991 | Pozzi et al. | 222/83 |
| 5,104,008 A | | 4/1992 | Crisci | 222/153 |
| 5,758,788 A | | 6/1998 | Lifshey | 215/278 |
| 5,853,109 A | | 12/1998 | Elliott | |
| 5,975,369 A | | 11/1999 | Yurkewicz et al. | 222/153.06 |

FOREIGN PATENT DOCUMENTS

| | | | | |
|---|---|---|---|---|
| AU | A-40755/95 | | 6/1997 | |
| AU | 199959309 | A1 | 5/2000 | |
| DE | 43 23 666 | A1 | 1/1994 | |
| EP | 0 947 433 | A1 * | 10/1999 | B65D/5/74 |
| FR | 2290 366 | | 6/1976 | |
| GB | 1211168 | | 11/1970 | |
| GB | 2 100 237 | A | 12/1982 | |
| JP | 08091418 | A | 4/1996 | |
| WO | WO 89/02399 | | 3/1989 | |
| WO | WO 93/14990 | | 8/1993 | |
| WO | WO 98/00348 | | 1/1998 | |
| WO | WO 98/40289 | | 9/1998 | |
| WO | WO 99/00311 | | 1/1999 | |
| WO | WO 99/44907 | | 9/1999 | |

* cited by examiner

*Primary Examiner*—Gene Mancene
*Assistant Examiner*—Patrick Buechner
(74) *Attorney, Agent, or Firm*—Greer, Burns & Crain, Ltd.

(57) ABSTRACT

A resealable cap for a container is disclosed, the cap having a seal piercing element, the liquid in the container being initially separated from the piercing element by a seal. The cap includes a collar, a neck portion and a top portion. The top portion includes the seal piercing element. There is a liquid passageway through the cap, after the top portion has been moved from an initial position to a closed position (thus piercing the seal) and thence to an open position. Thereafter the cap can be resealed and opened repeatedly, by movement of the top portion from the open position to the closed position and vice versa. Numerous embodiments of the invention are disclosed.

34 Claims, 29 Drawing Sheets

PIERCING CAP FOR A CONTAINER

TECHNICAL FIELD

The present invention relates to a caps for containers, wherein the caps include a piercing element for piercing a cover within the container. This cover can be a seal or a foil and the cap includes the means for breaking the foil, creating a liquid passageway from the container, and the ability to re-seal the container.

BACKGROUND ART

Different styles of caps of lids for containers (for liquids and liquid suspensions) are prolific. There are a variety of forms which can include, for example: a tamper-evident ring; the ability of a cap to be re-sealable; the screw threading of a cap onto the container; and re-sealable tops ("sipper tops"). The caps and containers may be one off uses, or may be re-useable; for example, the cap having a screw thread.

Containers are also available in which the top of the container (within the cap) is sealed with a foil or cover. This could be plastic or foil, a combination of these, cardboard or any number of materials or combination of materials. Generally the seal is heat annealed, or laminated, to the top edge of the container, usually to retain the contents in a sterile condition until they are required. The manual piercing or releasing of such a seal can sometimes be very difficult. In addition to removal of the cap on the container, considerable control force may be required to pierce the seal and provide a liquid passage from the container.

Mechanical means for piercing the seal can be used—a knife or the like. However all these solutions require that the cap be removed, the seal pierced and the cap re-seated on the container. This is required as the cap provides part of the liquid pathway for material from the container.

Solutions to some of these problems are also provided in other disclosures. U.S. Pat. No. 4,638,927 discloses a container and cap with a piercing element. However there is no liquid passageway through the piercing element, the liquid passageway (once the seal has been pierced) being provided separately and without means to seal said liquid within the container. U.S. Pat. No. 3,347,410 provides a cap that requires separate sealing after breaching of the foil seal.

PCT AU/97/00400 provides a cap which has a partially moveable top portion. It has a centrally placed piercing element connected to the top portion. However the top portion is pulled up to pierce the seal and release the material within the cap into the container. There is no internal means to form a tamper-evident means integrally with the cap. Further, the liquid seal provided once the foil seal is pierced is provided below the top of the container so that the container cannot be fully emptied.

AU 40755/95 provides four or five parts of a cap to perform the functions of initial sealing of the liquid in the container, tamper-evident means, piercing means, resealing means and liquid passageway. The manufacture of such parts adds considerably to the cost and complication of assembly and the container is not capable of reuse.

JP 8091418 provide a cap which incorporates a mixture which can be added to the liquid in the container. However once the mixture is added to the container the cap provides no liquid pathway for release of the mixture out of the container.

U.S. Pat. No. 5,758,788 also provides a cap for a container with a seal piercing means. However there is no method within the cap for re-sealing the container after the seal is broken.

WO99/44907 provides a cap with a cover. However the cover is required for resealing the liquid in the container once the seal within the container is broken. There is further sealing means in the cap.

U.S. Pat. No. 4,982,875 provides a cap with a piercing element and cover. However the cover and part of the cap (which incorporates the piercing element) must be removed before there is a liquid passageway from the container through the cap.

WO99/00311 provides a piercing element, but no means to reseal and provides no liquid passageway once the first seal is broken. Thus the cap must be removed before liquid can be removed from the container.

U.S. Pat. No. 5,975,369 provides a "sipper top" style cap with a top portion. However, the cap itself in the parts provided cannot provide tamper-evident means, nor a piercing element.

WO89/02399 provides a cap which is re-sealable. However, there is no liquid passageway therethrough, nor does it incorporate tamper-evident means within the cap itself.

An object of the present invention is the provision of a cap for a container wherein the cap performs a plurality of functions which include: a seal to retain liquid within the container, and which, when combined with the container provides, a means for breaking the seal, a re-sealable liquid passageway, without the need for removal of the cap from the container and, a tamper-evident means.

A further object of the invention is the provision of a cap for a container which provides useful alternatives to the above mentioned previous caps and containers.

A further object of the present invention is the provision of a cap and container so as to offer an economic alternative to presently available containers.

Further aspects and advantages of the present invention will become apparent for the ensuing description which is given by way of example only.

DISCLOSURE OF INVENTION

According to one aspect of the present invention there is provided a cap for a container, said container having a top opening and being capable of containing a liquid, said cap incorporating a seal piercing element, and wherein:

- the liquid in the container is initially separated from said piercing element by a seal; said cap including:
  - a collar with means for securing the cap to the container about the top opening, said collar being formed with a liquid passage therethrough;
  - a neck portion;
  - a top portion which is moveable, has a liquid passage therethrough, and comprises the seal piercing element; and wherein
    - the top portion is moveable between three positions, these positions being an initial position, an open position and a closed position, the initial position being a visual indicator of a sealed container and wherein the top portion is moveable from the initial position to the closed position and, when first so moved, causes the piercing element to pierce the seal, and thereafter when said top is moved from the closed position to the open position a liquid passage way is created for the liquid from the container to outside the cap, and wherein thereafter when the top portion is in the closed position, one or more elements of the top portion bear against one or more elements of the neck portion, or engage therewith, to provide a liquid seal between the top portion and the neck portion;

and wherein said cap further includes:

releasable means for releasably maintaining the top portion in the initial position and releasable means for releasably retaining the top portion in the open position; and wherein when the top portion is in the initial position, the liquid is sealed within the container by said seal.

According to a further aspect of the present invention there is provided a piercing cap for a container as described above, wherein the neck portion and collar are formed integrally.

According to a further aspect of the present invention there is provided a piercing cap for a container as described above, wherein said top portion and said piercing element are formed integrally.

According to a further aspect of the present invention there is provided a piercing cap for a container substantially as described above wherein said piercing element is in a form selected from: one or more sharpened edges; and one or more sharpened points. Optionally, the or all points and/or edges are peripherally positioned on the bottom of the sides of the top portion. When the or all points/edges are peripheral, the bottom of the top portion may optionally be formed at an angle to the sides of the top portion.

In a preferred aspect of the present invention there is provided a piercing cap for a container wherein said seal is made from material selected from: aluminium foil; plastic; rigid plastics material; cardboard or wood products; a plastics material; and a combination of these.

According to a further aspect of the present invention there is provided a piercing cap for a container as described above wherein said seal is formed integrally at, or adjacent the top of, the collar.

Alternatively, said seal is heat annealed to the top of said container after insertion of liquid into said container.

In a further aspect of the present invention of the above described cap, the cap further includes a removable cover over a part of the cap, which cover may incorporate further and additional tamper evident means, of known type. The cover may optionally be releasably securable to the cap or to a portion of the cap. This permits the cover to be repeatedly pulled on and off the cap. Alternative the cover may be releasably secured to the container, over the cap.

In a yet further aspect of the present invention there is provided the above described cap, wherein said top portion includes cylindrical side elements, which are positioned on the outside of the top part of the neck portion, wherein said side elements engage with the top part of the neck portion in a twisting or threaded motion, as said top portion is moved between the open and the closed positions. The helical motion of the top portion thus assists the piercing element in piercing the seal on the top of the container.

According to a further aspect of the present invention there is provided a piercing cap for a container as described above, wherein said neck portion includes cylindrical sides which are positioned outside of the side of the top portion.

According to a further aspect of the present invention there is provided a piercing cap for a container as described above, wherein said neck portion includes cylindrical sides and a centrally positioned projection for sealing against, or in, an opening in the top portion, when the top portion is in the closed position.

It will be appreciated that an advantage of the invention is that a variety of different styles of liquid passageways may be created by different arrangements of projections of the neck portion and holes in the top portion, and dependent on whether the top portion slides relative to the neck portion inside the neck portion or outside portion.

According to a further aspect of the present invention there is provided a piercing cap for a container as described above, wherein said seal piercing element includes a prong or pointed end which is centrally positioned with respect to the neck portion. Optionally, said prong is integrally formed with the top portion.

In a yet further aspect of the present invention there is provided a piercing cap for a container as described above, wherein said piercing element is a separate element within said top portion, said neck portion being moveable between two positions: an upper position and a lower position, and wherein said upper position forms part of the initial position of the top portion, and wherein when said top portion is in the initial position and is moved to the closed position, said piercing element is pushed from the upper position to the lower position; and thereafter said piercing element remains or is retained in said lower position.

In a yet further aspect of the present invention there is provided a piercing cap for a container as described above, wherein said initial position and said open position are the same positions of the top portion relative to the neck portion.

According to a still further aspect of the present invention there is provided a container, seal and cap, said cap being substantially as described above.

According to a still further aspect of the present invention there is provided a container, seal and cap, said container including a liquid, or liquid suspension.

It will therefore be appreciated that containers for holding any type of liquid, from a highly viscous liquid to a liquid/liquid suspension of low viscosity, can be sealed with a seal and a cap in accordance with the invention. The seal piecing element is used to pierce the seal without the need to remove the cap from the container, and thereafter the cap can be used to remove the liquid from the container. This can be done by pouring, sipping, or squeezing, the liquid from the container through the liquid passageway, or under the operation of gravity. Additionally, liquid can be sealed in the container if all the liquid is not removed from the container at one time.

BRIEF DESCRIPTION OF DRAWINGS

Further aspects of the present invention will become apparent from the following description which is given by way of example only and with reference to the accompanying drawings in which:

FIG. 4 shows the cap of FIG. 2 in the closed position with the cover on;

BEST MODES FOR CARRYING OUT THE INVENTION

Figure 1:
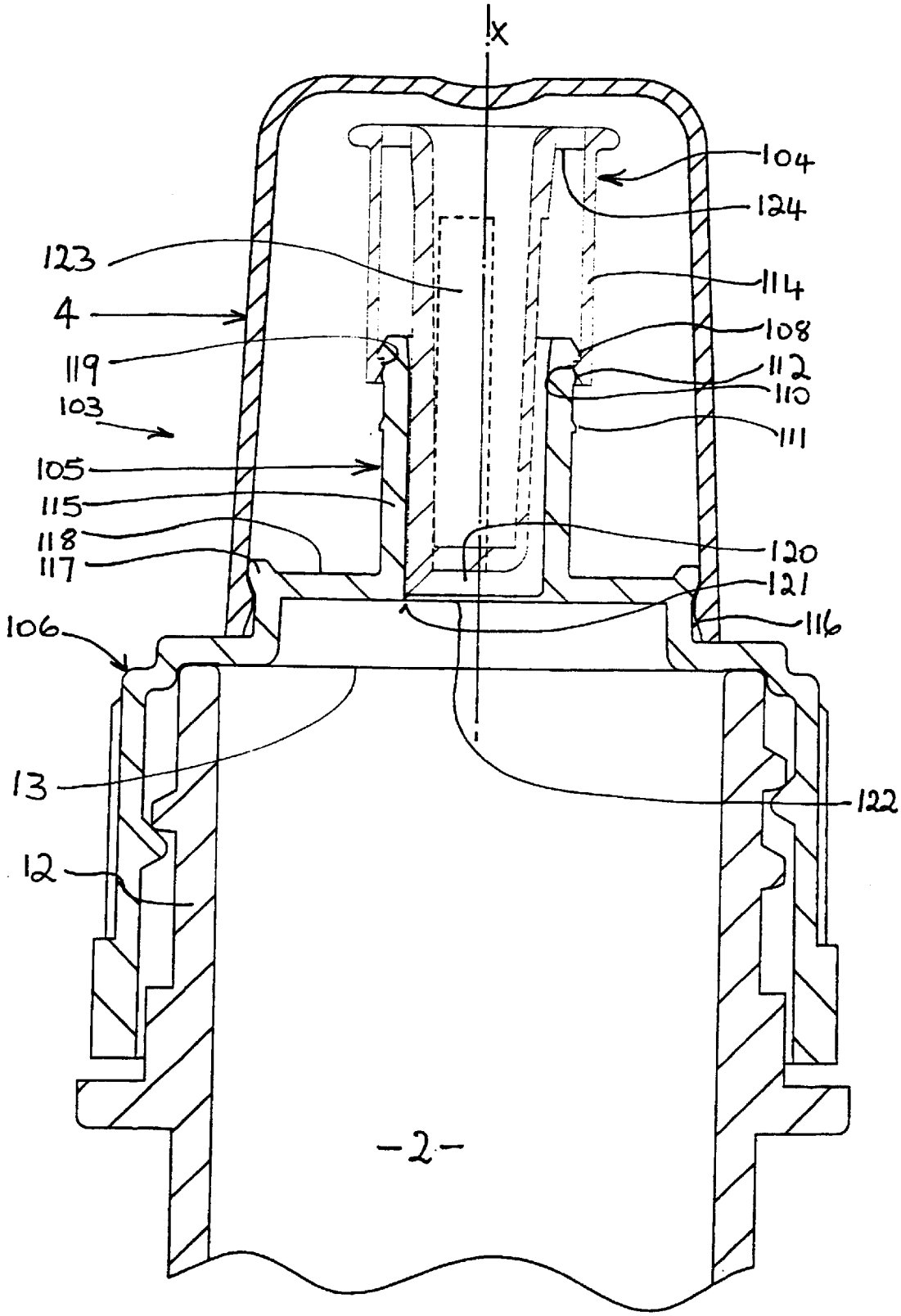
FIG. 1 is a section view of a cap according to a first preferred embodiment of the present invention, showing the piercing element integral with the top portion and the top portion being in the initial position.

The invention will be particularly described with reference to the first preferred embodiment as shown in FIGS. 1–4. Like parts through the remaining preferred embodiments are referred to by like numbers, and unless otherwise described, remain the same as described for the first preferred embodiment.

Referring now to FIGS. 1–4 of the drawings, the first preferred embodiment of the cap 103 of the present invention is thereshown with a container 2. The container 2 is represented only by the top portion of the container with sides 12 about an opening to the top of the container. The opening is generally represented by the number 13. The cap 103 includes a screw-thread that is compatible with the screw-thread on the outside of the sides 12 of the container 2. Alternatively, the cap 103 may be snap fit to the top of the container 2, with the sides 12 being straight on both the inside and the outside thereof, the snap fit being of known type and operating in known manner. The fit can either be a releasable snap fit or not, as is desired.

The cap 103 can thus be fitted onto a container 2 with either a screw-thread or a snap fit and can be re-useable, or not, as is desired.

The cap 103 is shown with a (optional) cover 4, a neck portion 105 and a collar 106. The collar 106 incorporates the screw thread referred to above to connect the cap 103 to the container 2. The collar 106 also includes a straight side upper portion 116 (of a diameter which is the same as or less than that of the container 2). The collar 106 includes projections with projections 117 at the top thereof immediately adjacent a flat circular portion 118. The projections 117 may be continuous or intermittent around the circumference of the flat portion 118, as is desired.

The cover 4 incorporates a lower section of a complimentary shape to the projections 117 upper portions. Thus the cover 4 can inter-engage releasably with the cap 103 by releasable engagement of the cover 4 with the projections 117 of the collar 106.

The neck portion 105 incorporates cylindrical sides 115. At the top of the neck portion 105 is an outwardly facing circular projection or retaining hook 108. The circular projection 108 may be continuous around the circumference of the neck portion 105, or may be broken therearound, as is desired.

Spaced apart from, but adjacent to said circular projection 108 is a first projection 112 around the sides 115 of the neck portion 105. Spaced apart and below the first projections 112 is an annular indent 110, a second projection 111 (of similar type to projection 112) and a second annular indent 110. The first and second projections (112, 111) may be annular and continuous or interrupted about the annulus, as is desired.

The cap 103 also includes a top portion 104. The top portion 104 has sides 114 with a diameter greater than the sides 115 of the neck portion 105. At the bottom end of the sides 114 is included an inwardly facing projection 119 which, when the top portion 104 is in the initial position (FIG. 1) prevents the top portion 104 from being easily removed from the neck portion 105. The projection(s) 112 and indent 110 engage with top portion projection 119 to permit the top portion 104 to be retained in the initial position. The sides 114 of the top portion 104 are sufficiently flexible that motion of the top portion 104 in the direction of arrow A (FIG. 2) will permit the top portion 104 to slide over the projections 112 and 111 to be stopped against the flat face 118 of the collar portion 106.

The top portion 104 includes a circular bottom denoted by the numeral 120 with a shaped cutting (or tearing) edge and piercing point 121. The cutting edge 121 is peripherally positioned relative to the centre line X through the neck portion 105 and top portion 104.

A seal 122 is formed with the underside of the flat portion 118 of the collar 106. When the cap 103 is in the initial position (FIG. 1) the piercing point 121 is positioned immediately above and adjacent the seal 122. As the liquid in the container 103 is separated from the piercing point 121 by the seal 122.

The seal 122 can be made of any material but in this instance can be formed integrally with the collar portion 106 and made of the same material.

In addition to the liquid seals described above, additional sealing means may be added if desired. It will be appreciated that sealing means of known type may be added to the cap (between the top portion and the neck portion) and/or between the cap and the container. For example, inset channels with seated o-rings of known type may be added.

Figure 2:
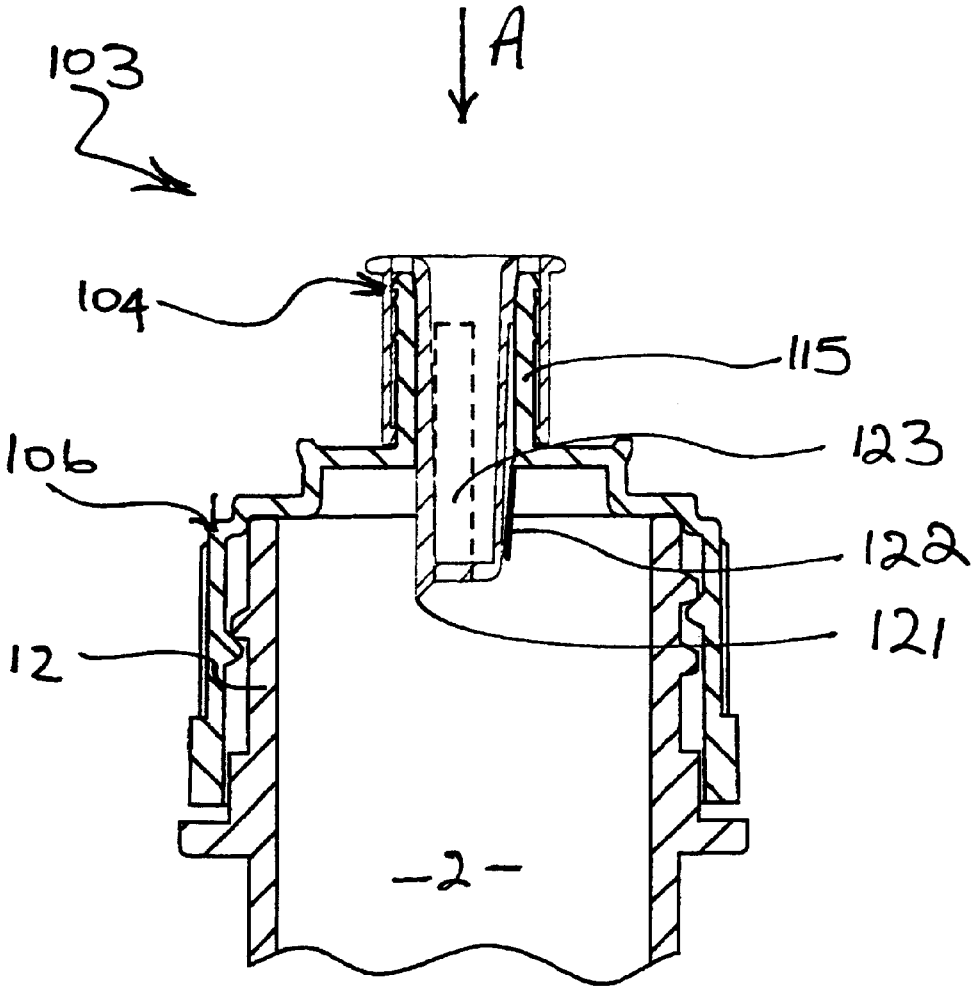
FIG. 2 is a second section view of the first preferred embodiment of the present invention showing the top portion in the closed position.
Figure 3:
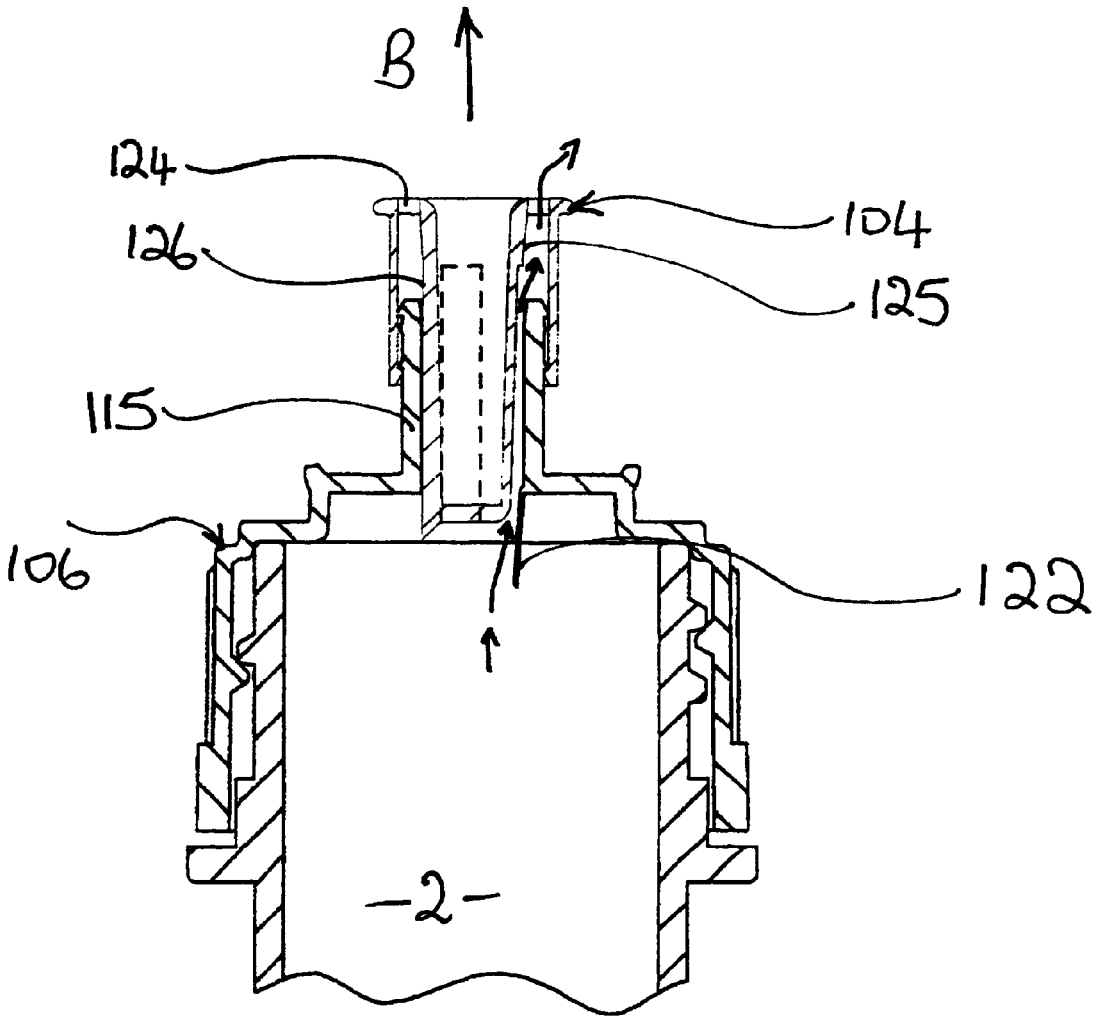
FIG. 3 is a section view of the cap of FIG. 2, with the top portion in the open position.
Figure 4:
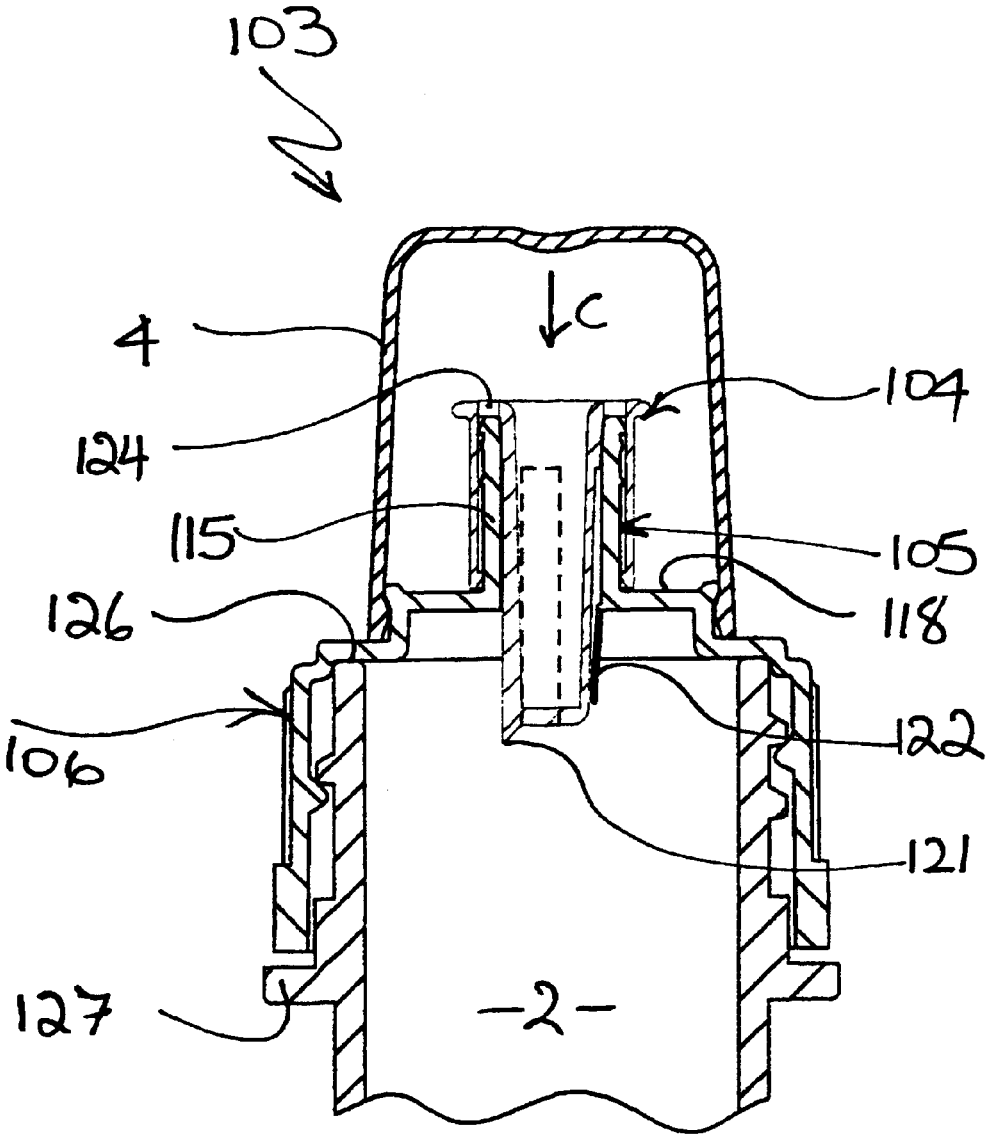

Referring to FIGS. 2, 3 and 4 the piercing of the cap 103 occurs as follows: downward pressure is applied to the top portion 104 so that the piercing point 121 breaks the seal 122 at the point where the seal 122 joins the flat portion 118 of the collar 106. A central element 123 of the top portion 104 provides rigidity to the top portion 104 as downward pressure is applied in the direction of arrow A (FIG. 2).

The top position 104 can be pulled in the upward direction (arrow B, FIG. 3). The second projections 111 retain the inward facing projection 119 of the top portion 104 and arrest upward motion. This causes the top portion 104 to be retained in an open position, partway between the initial position and the closed position (of FIG. 2). In this open position a liquid passageway is created (shown by arrows on FIG. 3) and the liquid in the container 2 is able to pass through the top of the top portion 104 via peripherally placed holes onto 4, when the container is up ended. When the cap 103 is again in the closed position (by the exertion of force in the direction of arrow C, as shown in FIG. 4) the liquid passageway between the top portion 104, the neck portion 105 and the collar 106 is closed by the top of the sides 115 which are shaped to fit within the holes 124.

Additionally, a flange 125, which is positioned on the outside of the sides of the piercing point 121 bear at the top of said element, against the inner face, or a portion of the inner face, of the sides 115 of the neck portion 105. Thus a liquid seal is created by the flange 125 bearing against the inside top of the sides 115 of the neck portion 105, and by the shaped tops of the sides 115 fitting into holes 124 of the top portion 104. These holes 124 may additionally operate as guides or keys for the correct engagement of the top portion 104 on or to the neck portion 105.

In the embodiment shown in FIGS. 1–4, the sloping sides of the top portion 104 (down to the piercing point 121) are shown a symmetrically, such that one face of the side 119, down to the piercing point 121, bears against an inner face of sides 115 of the top portion 105. This is in addition to the flange 125. However, it will be appreciated that the flange 125 may be completely annular, and that the face 119 of the piercing means, which bears against the inner face of sides 115 of the neck portion 105, may be omitted so that the flange 125 is completely annular.

As can be seen in FIGS. 1–4, the cover 4 is optional. If, however the cover 4 is present, additional tamper-evident means (not shown) may be provided between the collar 106 and the cover 4, in known manner. For example, a shrink wrap plastic seal may be provided, if desired.

The collar 106 and neck portion 105 are formed integrally, along with the seal 122. These elements are made of plastics material. If so desired, a pre-weakened area may be provided on the seal 122 between the edge of the flat flange 118 of the collar portion 106 and the seal itself 122.

The base 120 of the top portion 104 is shown as being substantially flat. However, it will be appreciated that this shape may be varied without departing from the scope of the invention.

As will be appreciated and known from the prior art, part of the liquid seal for the cap 103 on a container 2, between the collar 106 and the container 2, is provided in known manner by the collar 106 (and therefore the cap 103) being firmly screwed onto the top of the container 2 to provide a seal between the top of the container and the collar 106. This seal is generally denoted by the number 126 on FIG. 4.

The container 2 is shown as including an outwardly facing flange 127 (FIG. 4) immediately below the end of the collar 106 on the outside of the container 2. However, it will be appreciated that this is an optional feature and may be varied as is required for the shape and fit of the collar 106 to the container 2, and the general structural strength of the top of the container 2.

It will also be appreciated by those skilled in the art that the container 2 can be re-used with a fresh cap 103 with the seal 122 in position. This is the case whether or not the cap 103 is a snap fit or a screw thread fit to the container 2.

FIGS. 1–4 are a cross sectional view of the cap 103 showing the neck portion 105 and top portion 104 centrally positioned. However, it will be appreciated that the positioning of the neck portion 105 and top portion 104 may be off-centre from the axial centre line (not shown) of the container 2.

Figure 5:
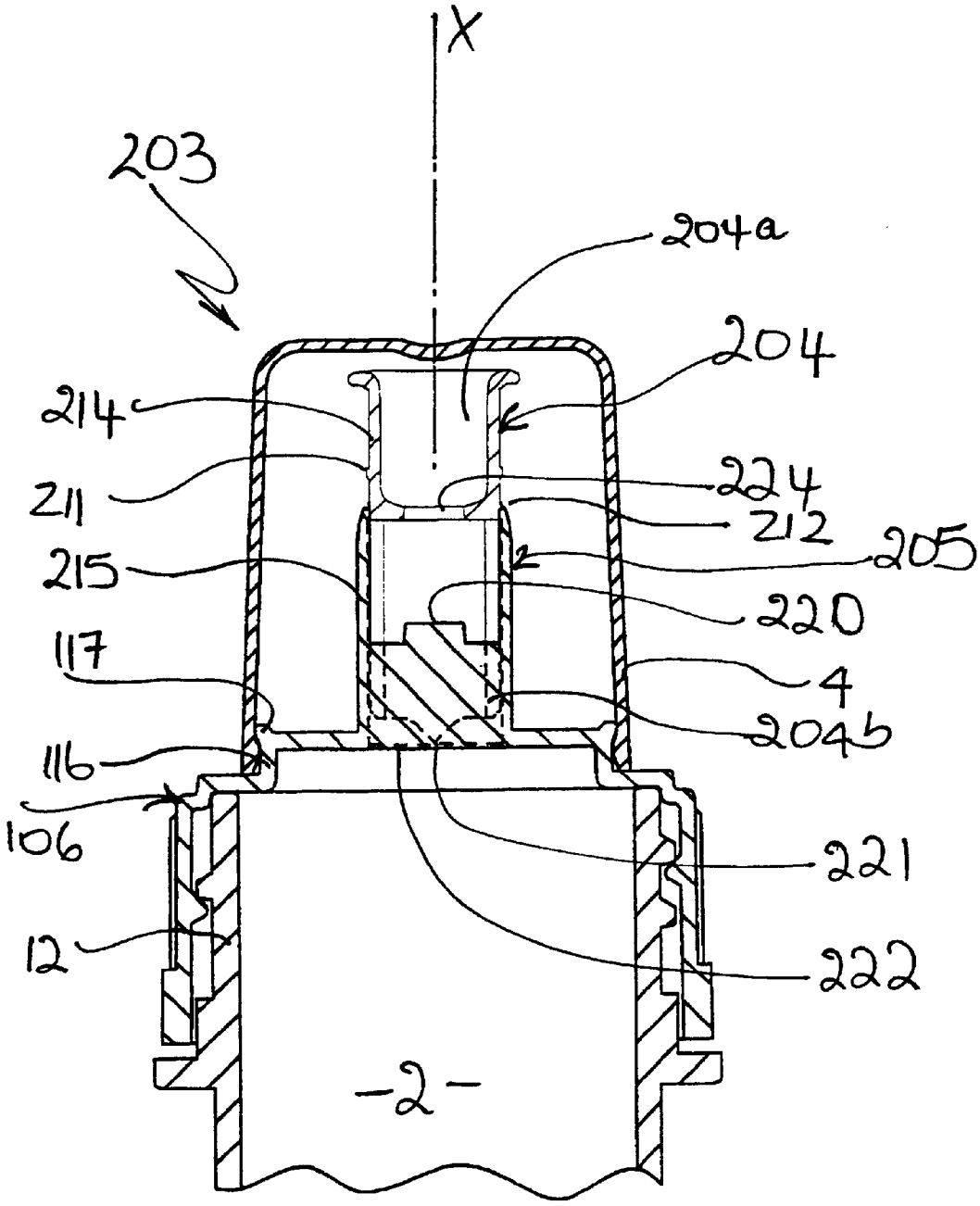
FIGS. 5–7 show a second preferred embodiment of the cap of the present invention in the same position as, respectively, FIGS. 1, 3 and 4 of the first preferred embodiment.
Figure 6:
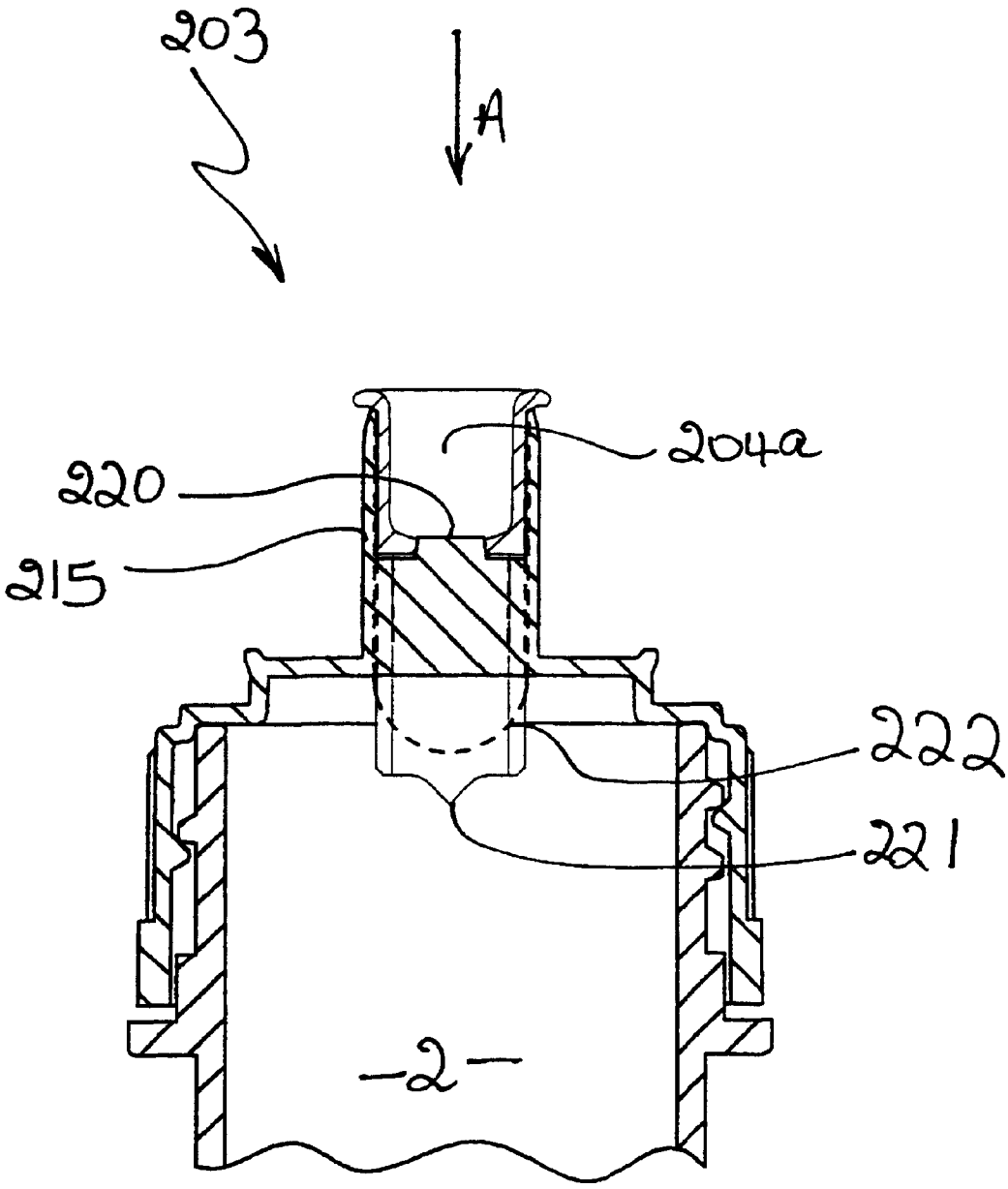
Figure 7:
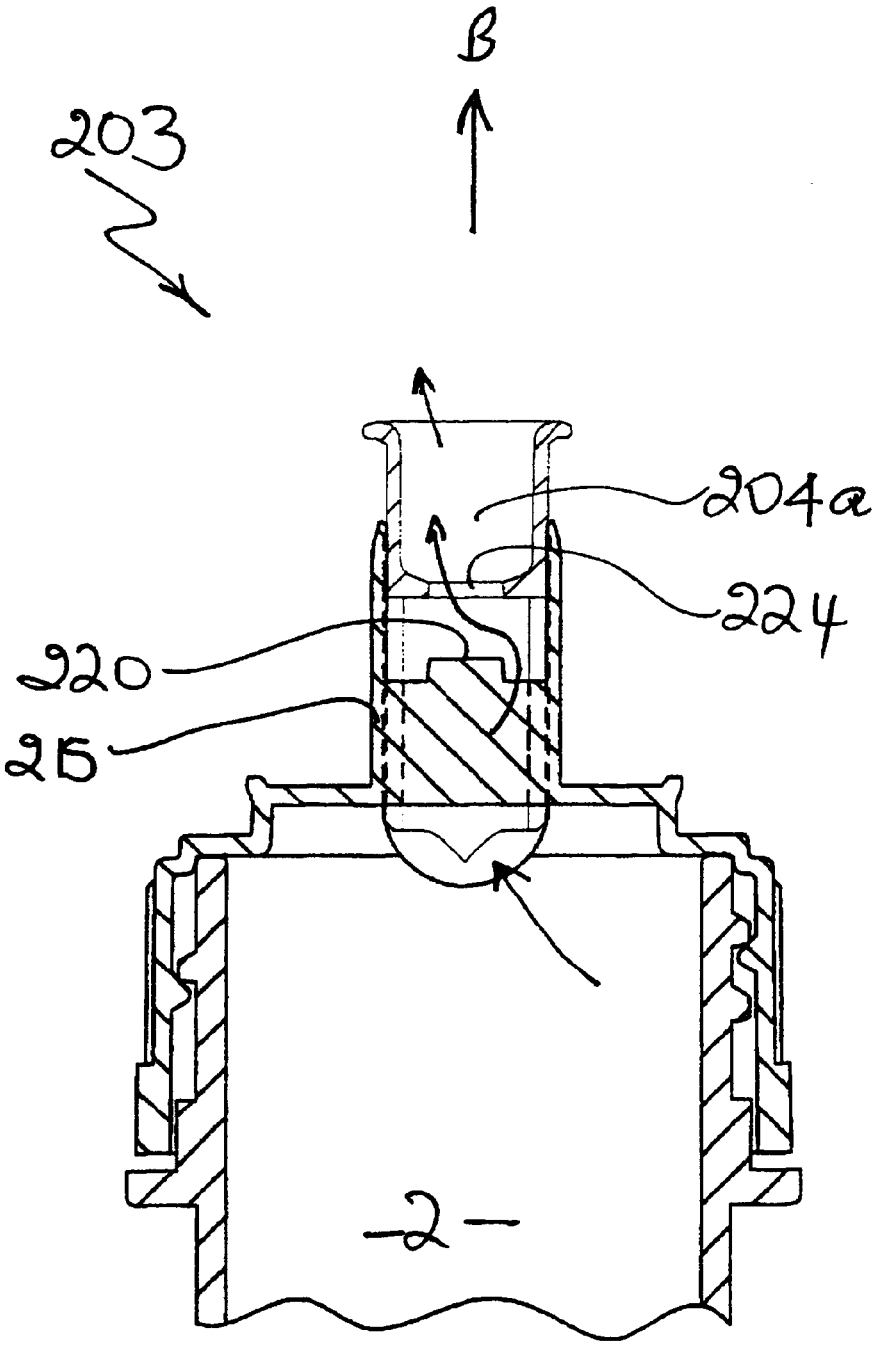

Referring to the second preferred embodiment, this is shown in FIGS. 5–7. In this embodiment the cap 203 includes a cover 4, collar 106, neck portion 205 and top portion 204. The cover 4 fits to the cap 203 in the manner described for the first preferred embodiment of the cap 103.

The sides 215 of the neck portion 205 have a diameter greater than the sides 214 of the top portion 204. The top portion 204 is in two separate parts 204*a* and the piercing means 204*b*. The piercing means 204*b* incorporates the piercing point 221, which is peripherally located with reference to the centre line X (FIG. 5) of the cap 203.

The downward motion in the direction arrow A (FIG. 6) pushes the top portion 204. This pushes the slidable piercing point 221 to a lower position (FIG. 6), breaking the seal 222. The neck portion 205 includes a centrally positioned projection 220 which is shaped to engage with a hole 224 (FIG. 7) of the top portion 204.

The liquid flow, once the seal 222 is broken by the downward motion of the top portion 204 and action of the piercing point 221, is shown in FIG. 7 by arrows. This liquid flow is through the centre of the top portion 204, around the centrally located projection 220 and through the hole 224 in the top portion 204.

As shown in FIG. 6 the liquid seal after the initial motion (as shown of FIGS. 5, 6 and 7) is provided by the engaged position of the projection 220 of the neck portion 105, with the hole 224 of the top portion 204. The sides 214 of the top portion 204 also engage with or bear against the sides 215 of the neck portion 205 to provide additional liquid seal to that provided by projection 220 in hole 224.

The projections 212 and 211 (FIG. 5) inter-engage with inwardly facing projections (not shown) on the neck portion 205. The manner of engagement is the same as that of the first preferred embodiment. However it will be appreciated that with the sides 215 of the neck portion 205 on the outside of the sides 214 of the top portion 204, that the position of these projections will be reversed, relative to the first preferred embodiment of the cap 103.

Figure 8:
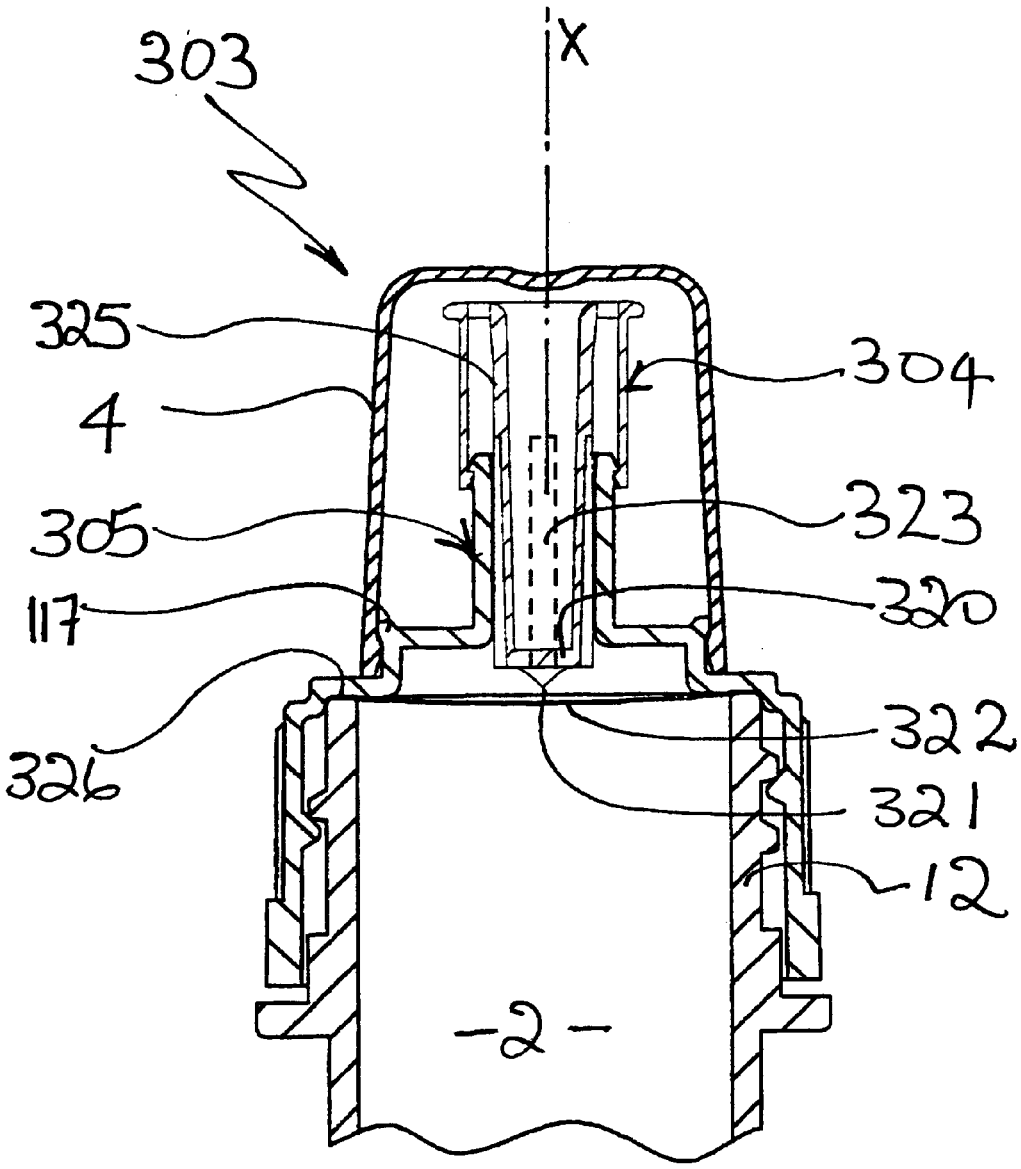
FIGS. 8–10 show views of a third embodiment of the cap of the present invention in the same position, respectively, as FIGS. 1, 3 and 4 of the first embodiment.
Figure 9:
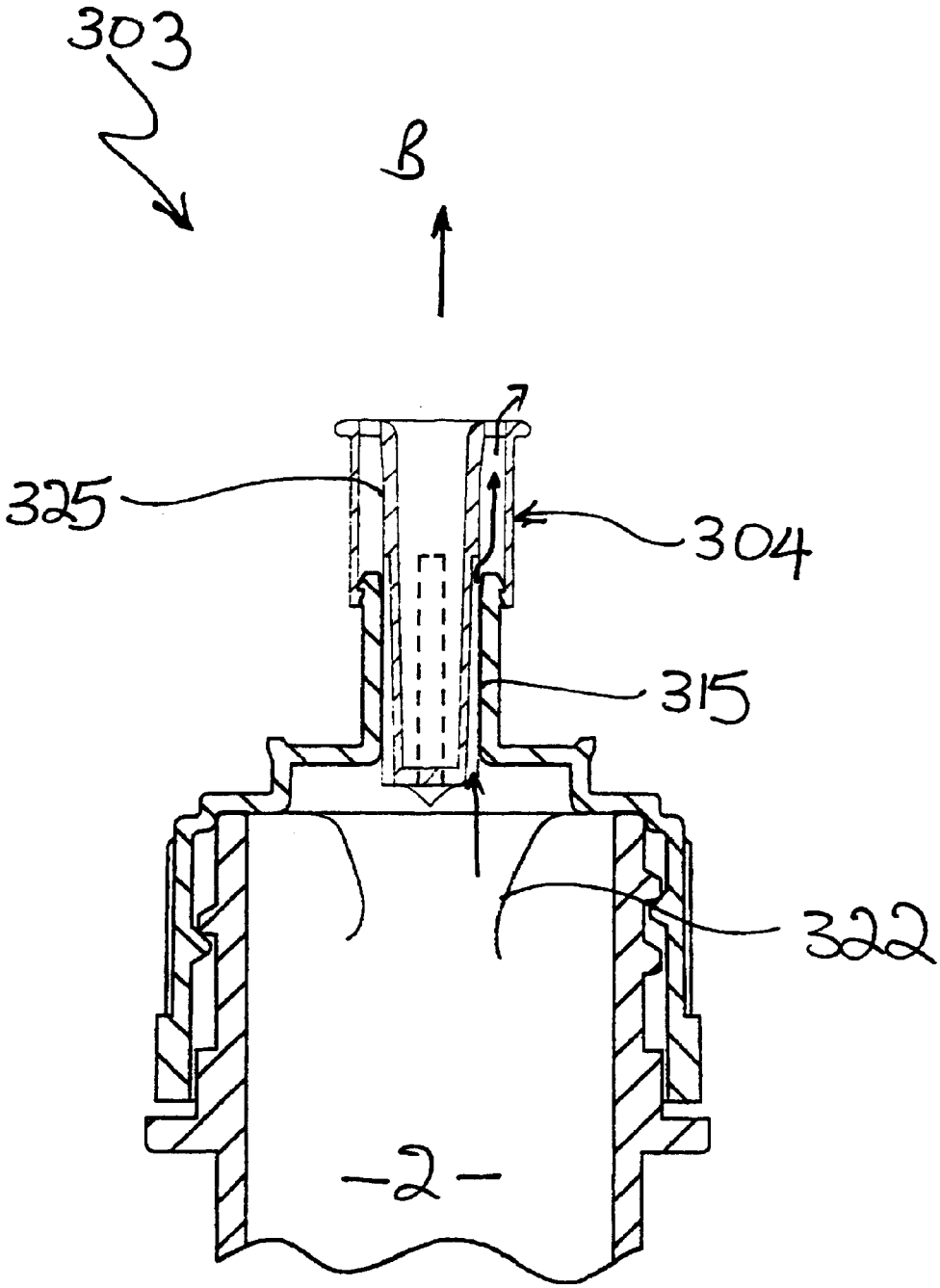
Figure 10:
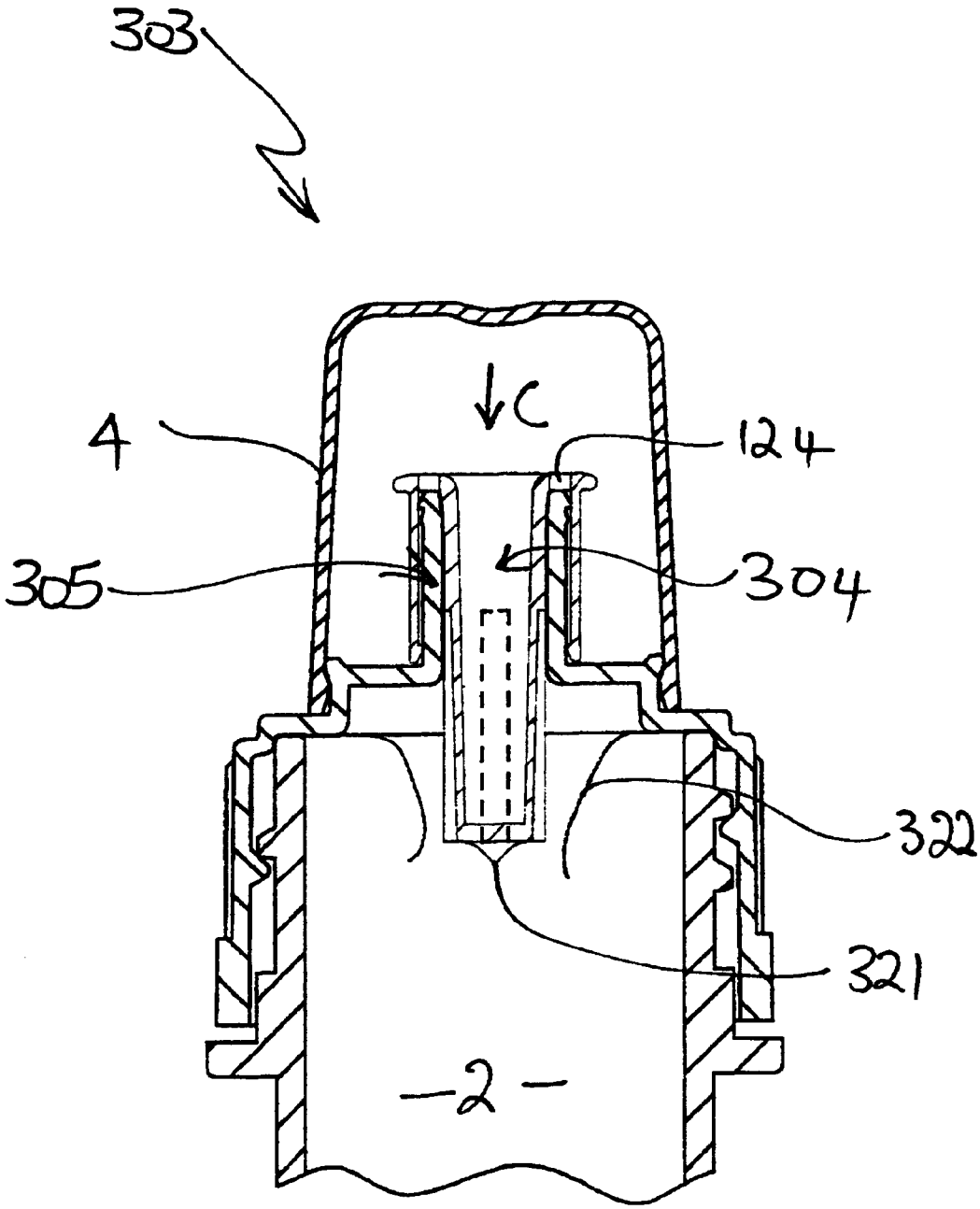

Referring to FIGS. 8–10 a third preferred embodiment of the cap 303 is thereshown. As with the first preferred embodiment, the top portion 304 incorporates a point 321 with an associated base 320. Central element 323 provides stiffening and rigidity to the top portion 304, in operation. In this third embodiment of the cap 303, the seal 322 is provided across the top of the container 2, between the container 2 and the collar 306, at point 326 (FIG. 8)

A further variation from the first preferred embodiment is that the flange 325 of the top portion 304 is formed entirely round the periphery of the piercing means and extends further down the sides thereof. Thus once the seal 322 is broken (FIG. 8), the top portion 304 pulled back to the open position (FIG. 9) and is then pushed down to provide a liquid seal as shown in FIG. 10, the flange 325 bears against the sides 315 of the neck portion 305 to form part of the liquid seal. In addition to this, holes 124 in the top of the top portion 304 engage with the top edge of the sides 315 of the neck portion 305, in like manner to that described with reference to the first preferred embodiment.

Figure 11:
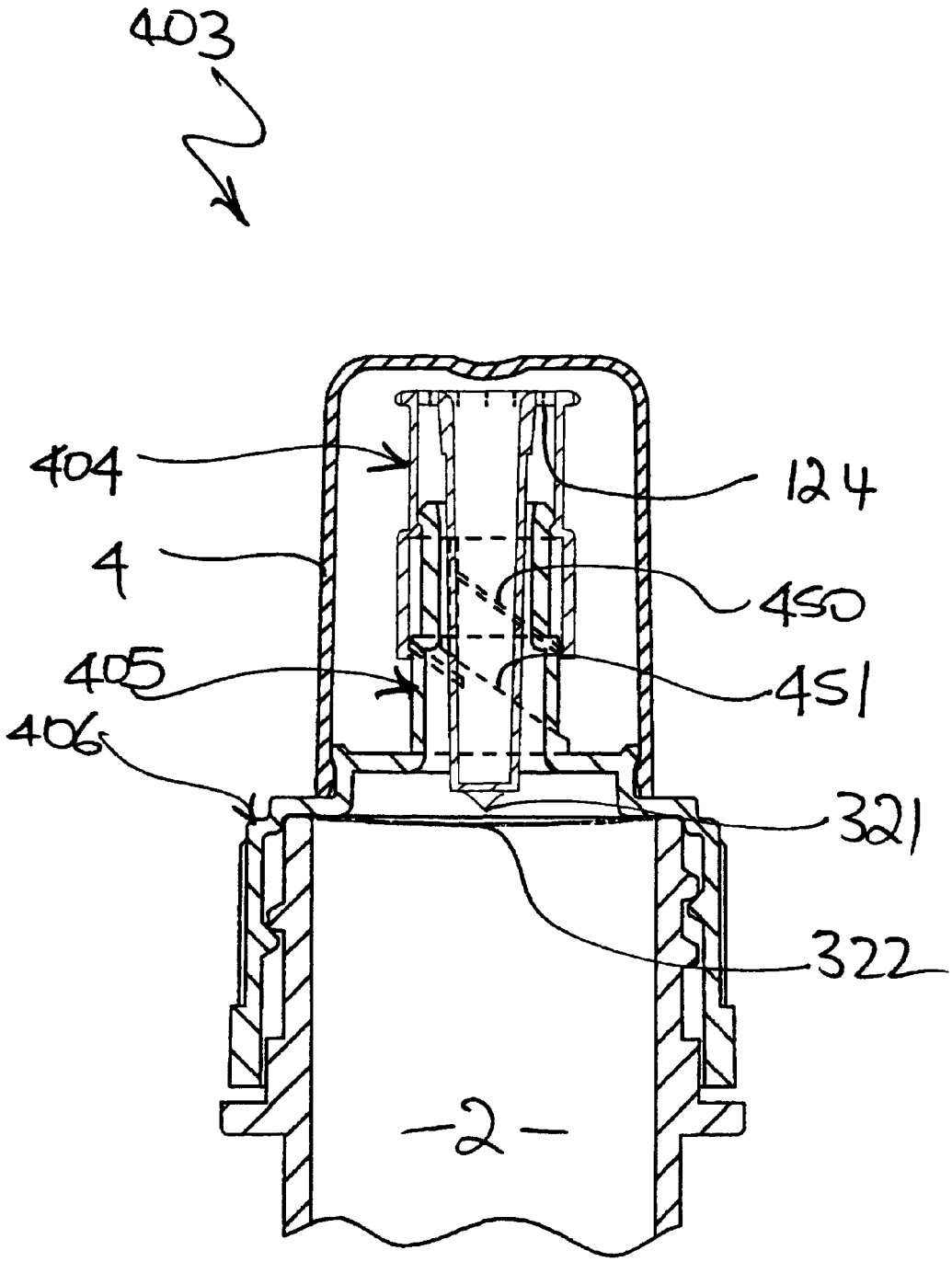
FIGS. 11–12 show a fourth embodiment of the cap of the present invention in the same position, respectively, as FIGS. 1 and 2 of the first embodiment.
Figure 12:
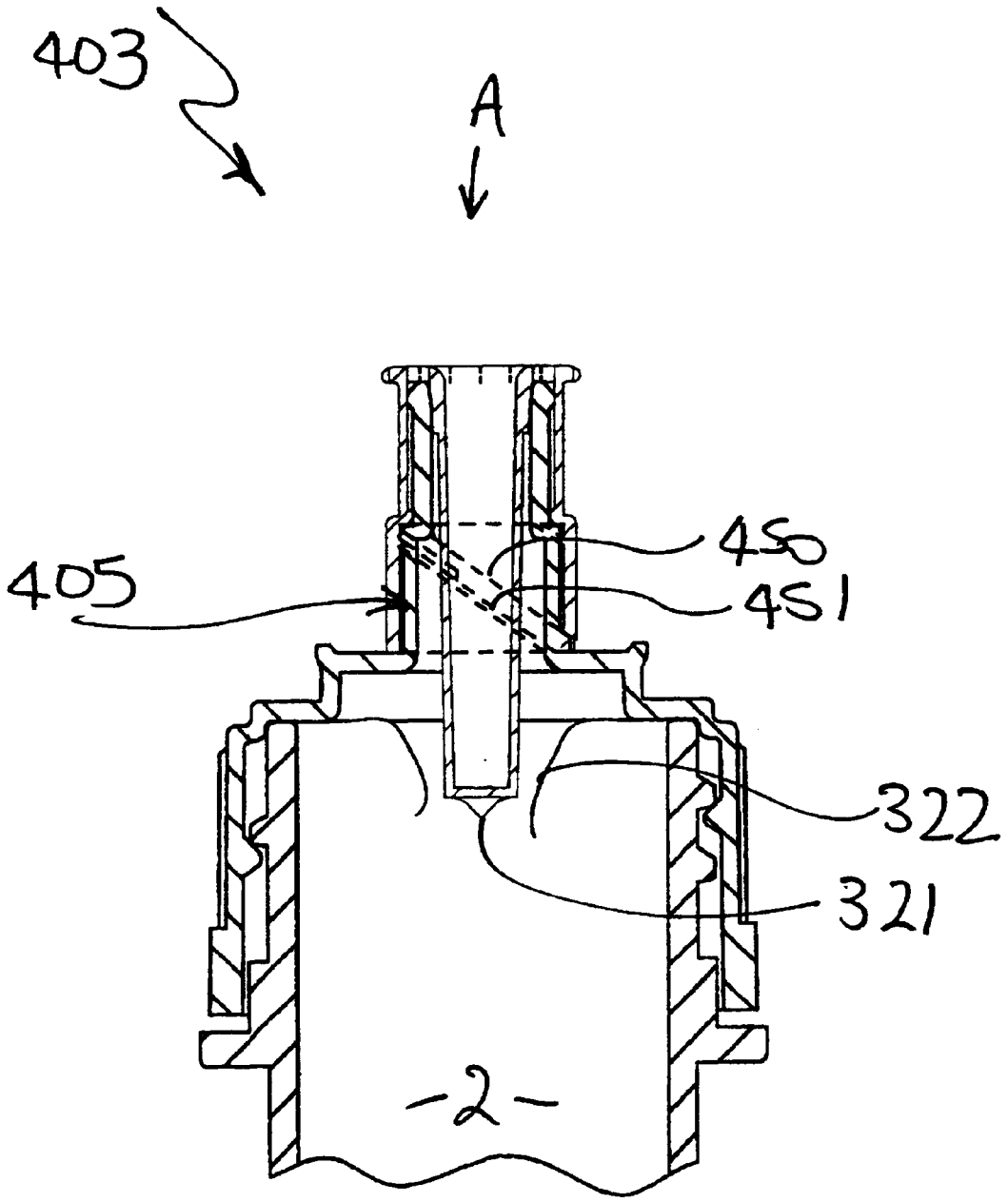

The FIGS. 11–12 show the fourth preferred embodiment of the cap 403 of the present invention which is in the manner of the third preferred embodiment shown in FIGS. 8–10. In this variation the top portion 404 incorporates a helical thread, or thread of large pitch (denoted by dotted lines 450 and 451. Thus the top portion 404 can be twisted down onto the neck portion 405 with the piercing point 321 piercing the seal 322 with a circular motion. This circular motion causes the point 321 to pierce and weaken the seal 322 in an arc as it descends, thus assisting in the breaking of the seal 322.

The cover 4 operates in the same manner as described for the first preferred embodiment. The liquid pathway when the cap 403 is open is the same as described for the third preferred embodiment of the cap 303.

Figure 13:
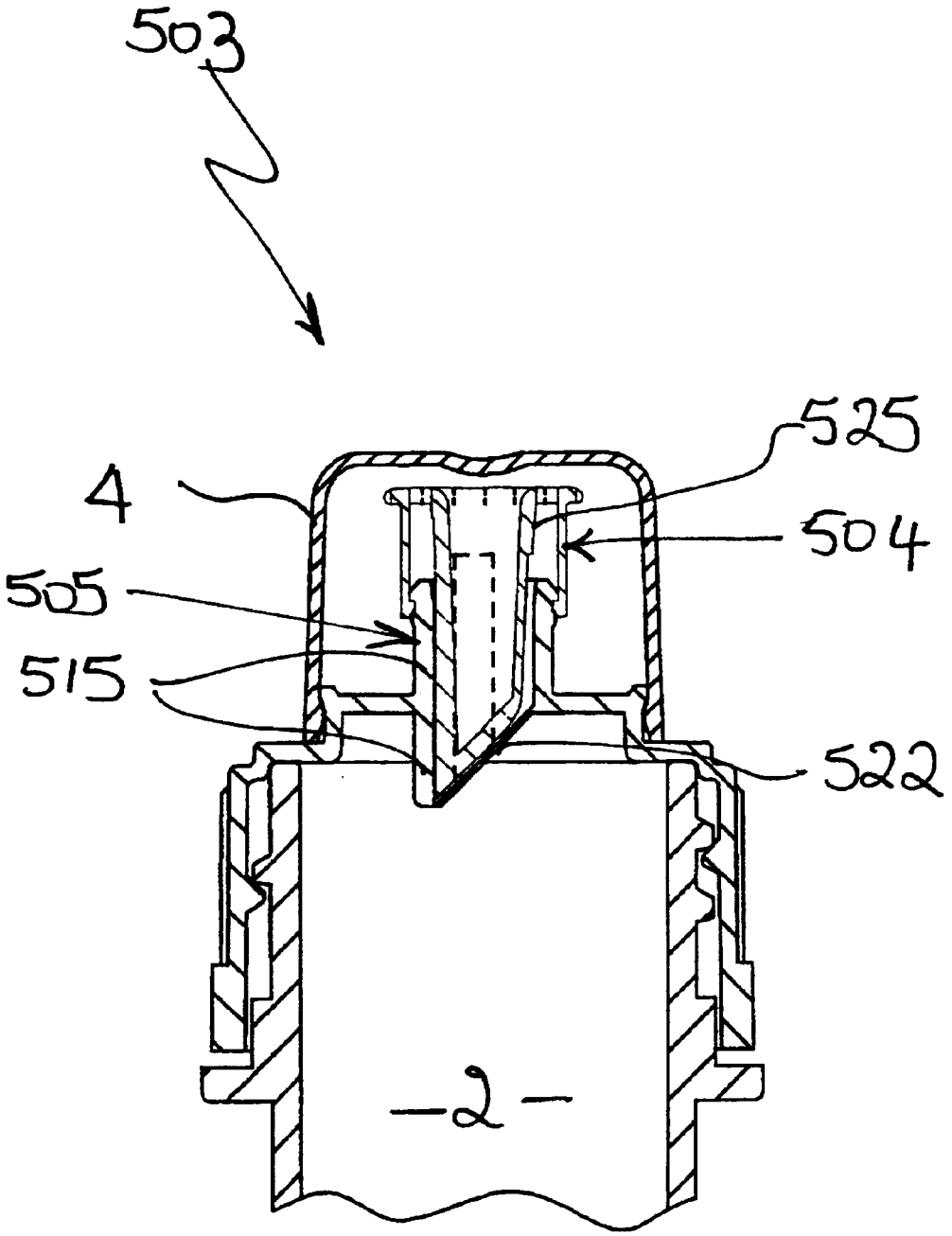
FIGS. 13–14 show a fifth preferred embodiment of the present invention in the same positions, as respectively, FIGS. 1 and 3 of the first embodiment.
Figure 14:
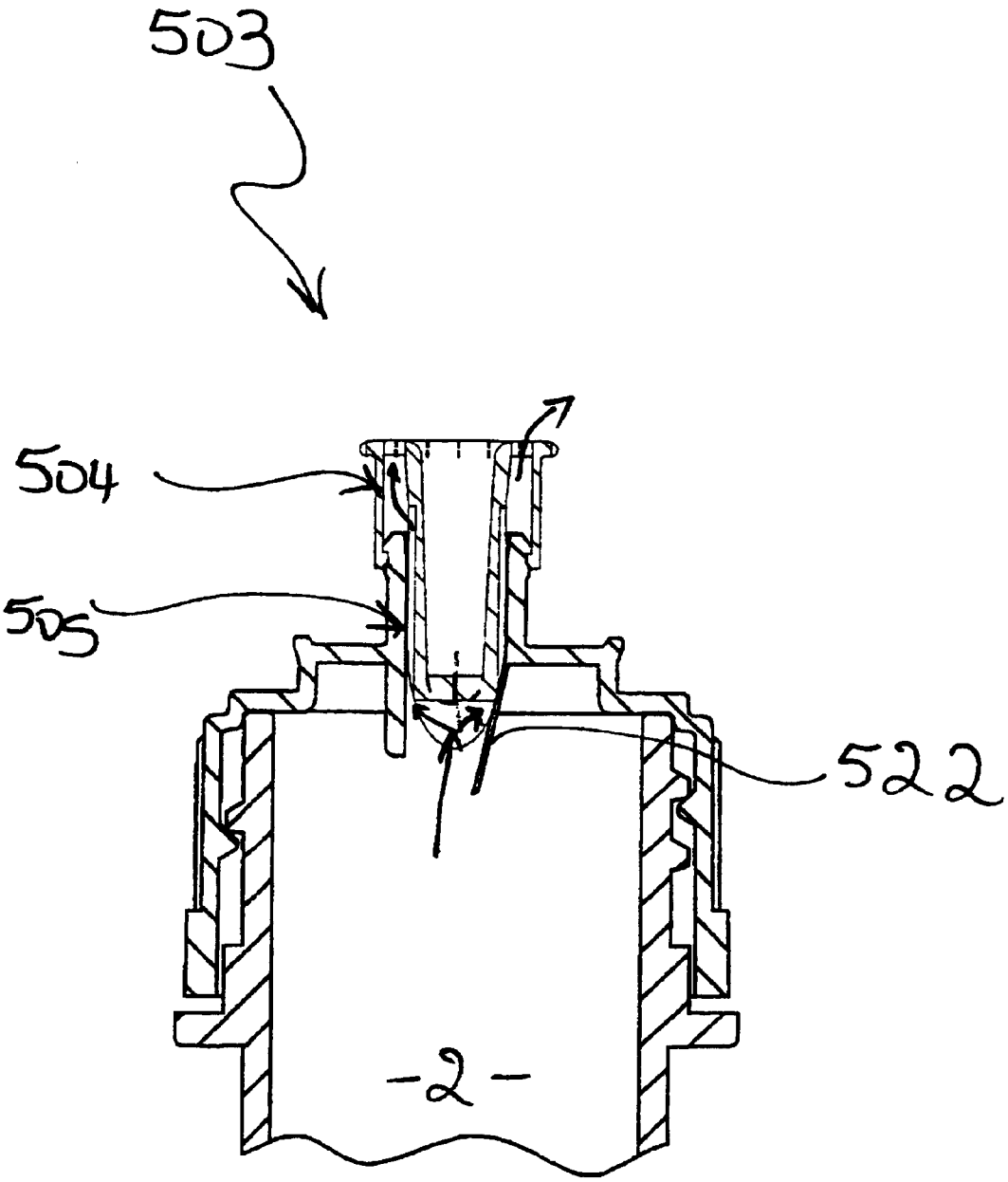

Referring to FIGS. 13–14 a fifth preferred embodiment of the cap 503 of the present invention is there shown. In this embodiment the initial position and the open position of the top portion 504 are identical. The projections and neck portion 505 operate in the manner described above as does the cap 4 and the means of placing the cap 503 on the container 2.

In this embodiment the seal 522 is positioned at an angle on the bottom of the neck portion 505. The sides 515 of the neck portion 505 incorporate a downward projecting portion, to accommodate the angled circular seal 522. The flange 525 operates as the sealing means when the top portion 504 is in the closed position, as described above with the first and third preferred embodiments. The liquid passages are as described above for the third embodiment.

Figure 15:
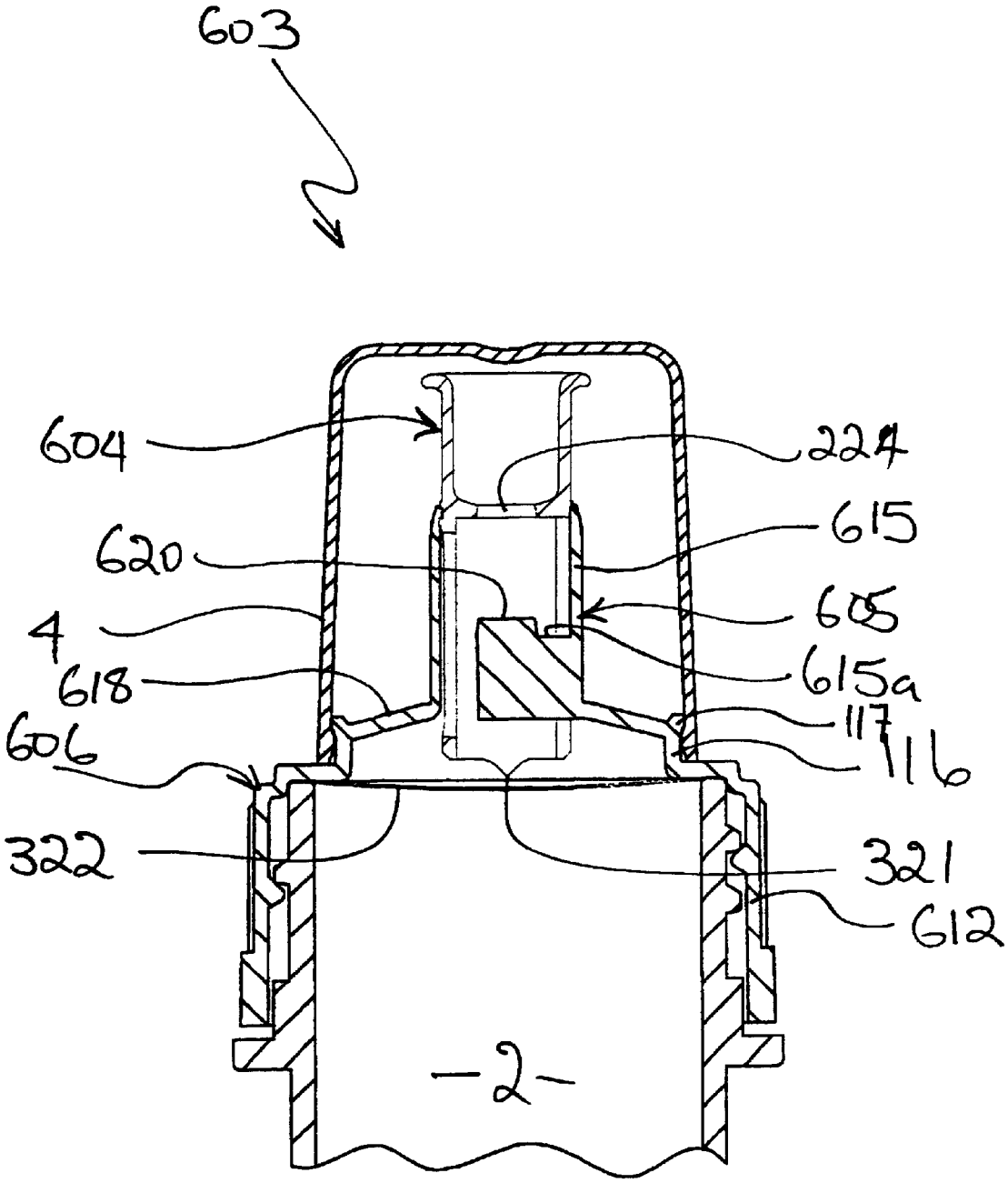
FIGS. 15–17 show a sixth preferred embodiment of the cap of the present invention in the same positions as respectively, FIGS. 1; 3 and 4 of the first preferred embodiment.
Figure 16:
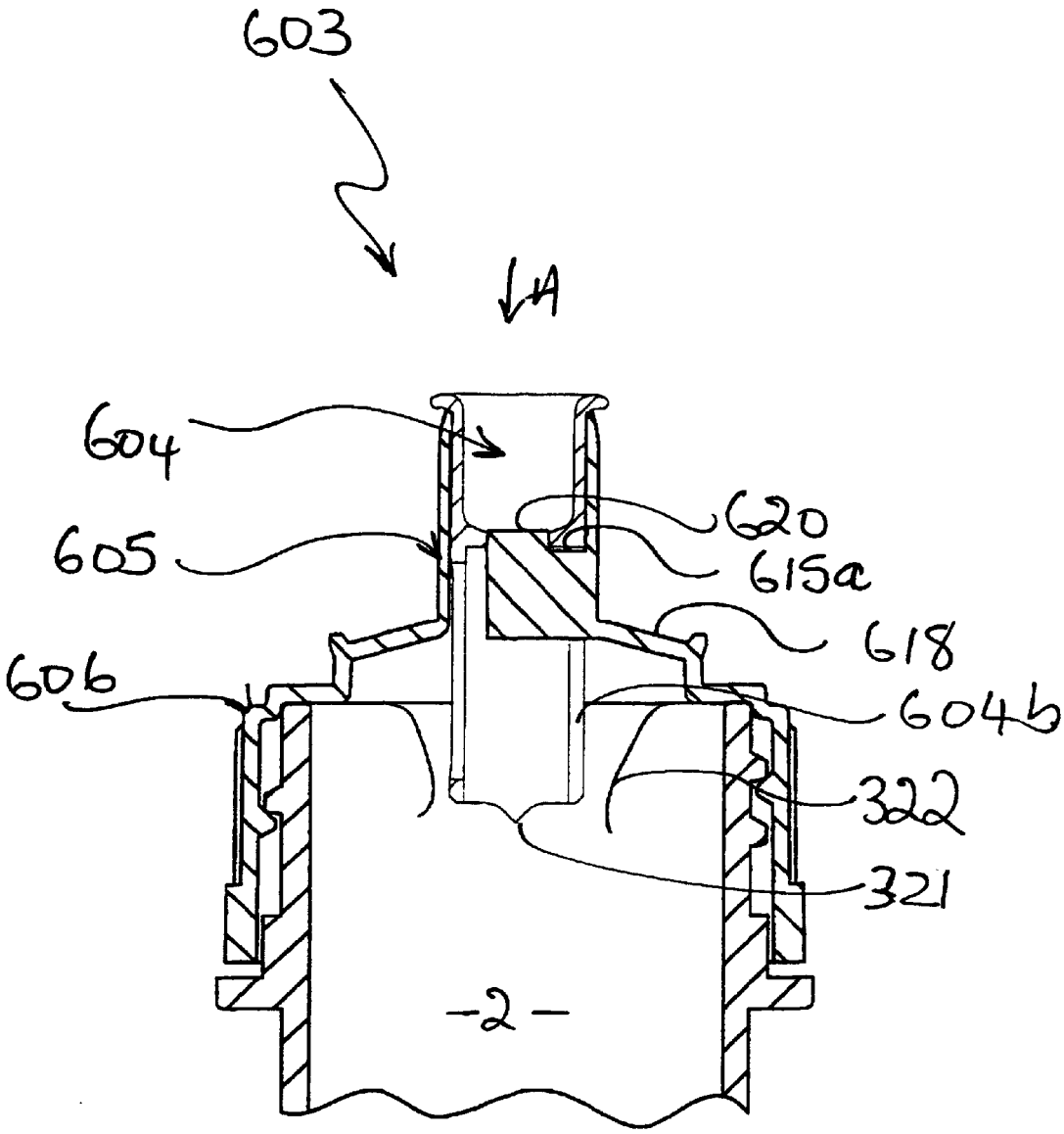
Figure 17:
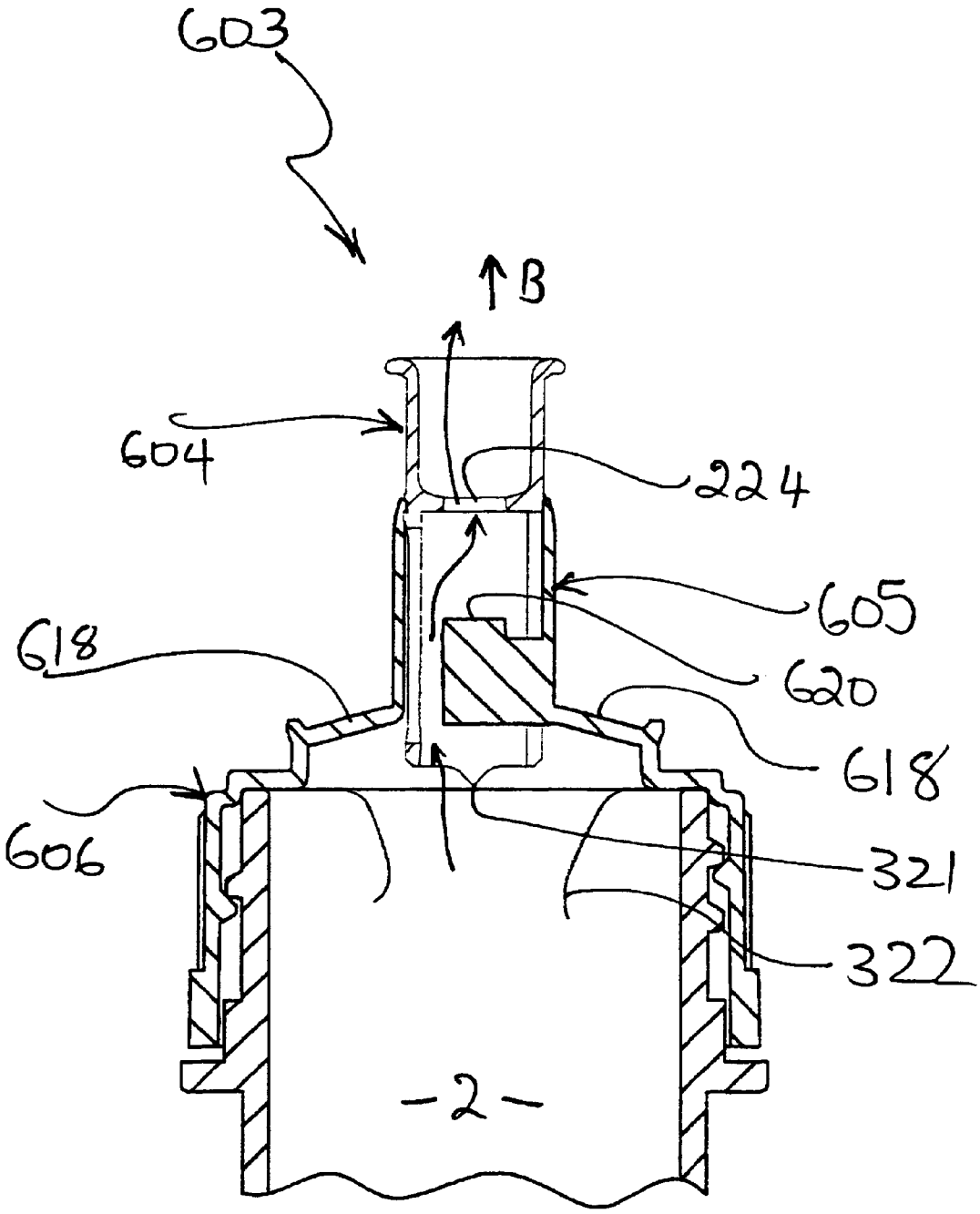

Referring to FIGS. 15–17 the sixth preferred embodiment of the cap 603 with cover 4 is there shown. The neck portion 605 and top portion 604 are of the type as generally described in the second preferred embodiment with reference to top portion 204 and neck portion 205. The piercing point 321 is a part of the top portion 604. The seal 322 is of the type described in the third preferred embodiment.

The collar 606 incorporates sides 612, portion 116 and projections 117 of the type described in the first preferred embodiment. As with the first preferred embodiment, the neck portion 605 is integrally formed with the collar 606. The variation on this preferred embodiment to the neck portion and collar (605, 606) is that the intermediate flange 618 slopes upwardly and inwardly (whereas in the first preferred embodiment this was a flat flange 118). The central projection 620 is of a similar type to that shown in the second preferred embodiment (projection 220) except that projection 620 it is connected to one side 615 of the neck portion 605 by one connecting flange 615*a*. This arrangement leaves a liquid passage about the flange 615*a* which, in plan, is virtually completely circular except for projection 615*a*.

Figure 18:
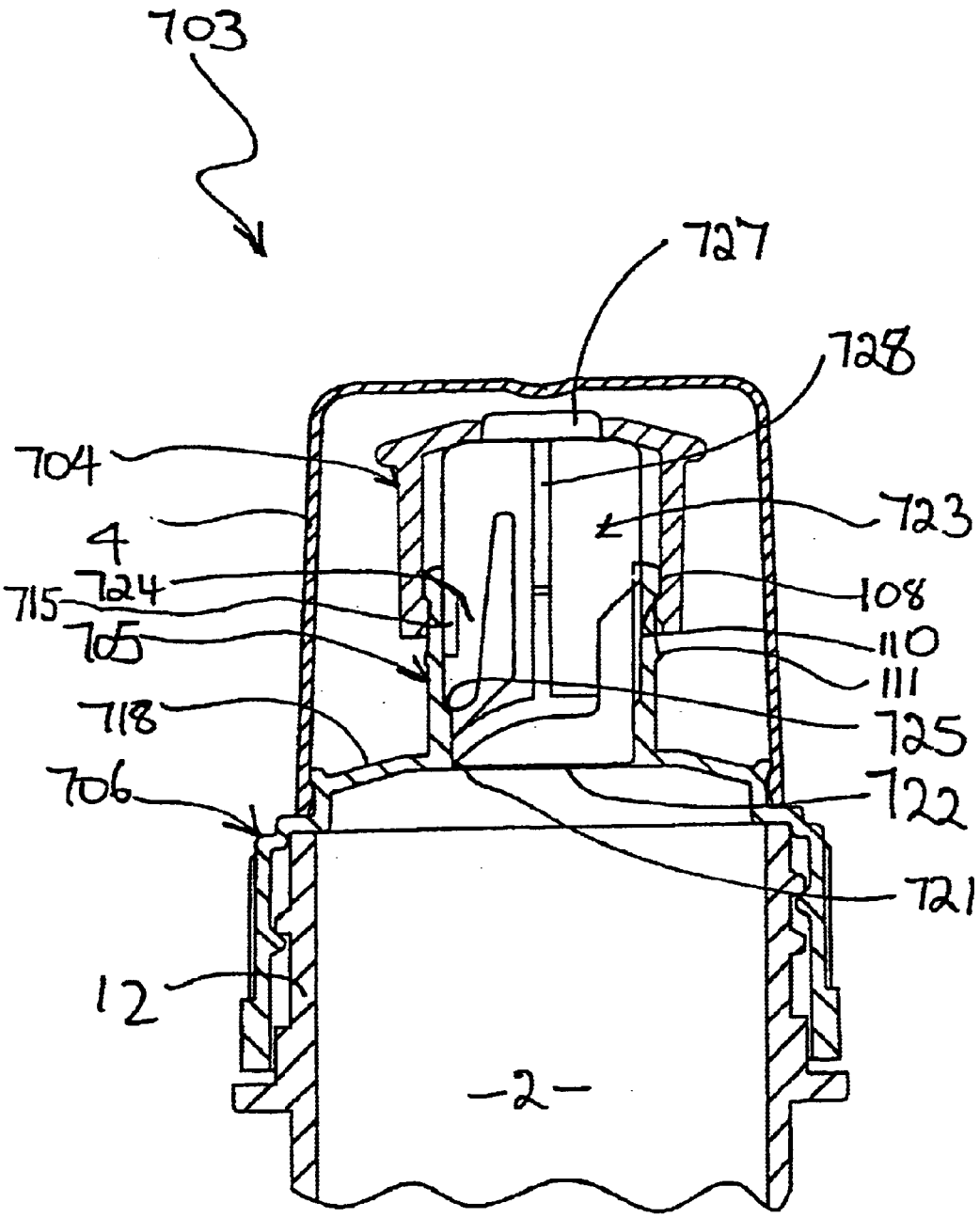
FIGS. 18–20 show a seventh preferred embodiment of the cap of the present invention in the same positions respectively, as those of FIGS. 1, 2 and 3.
Figure 19:
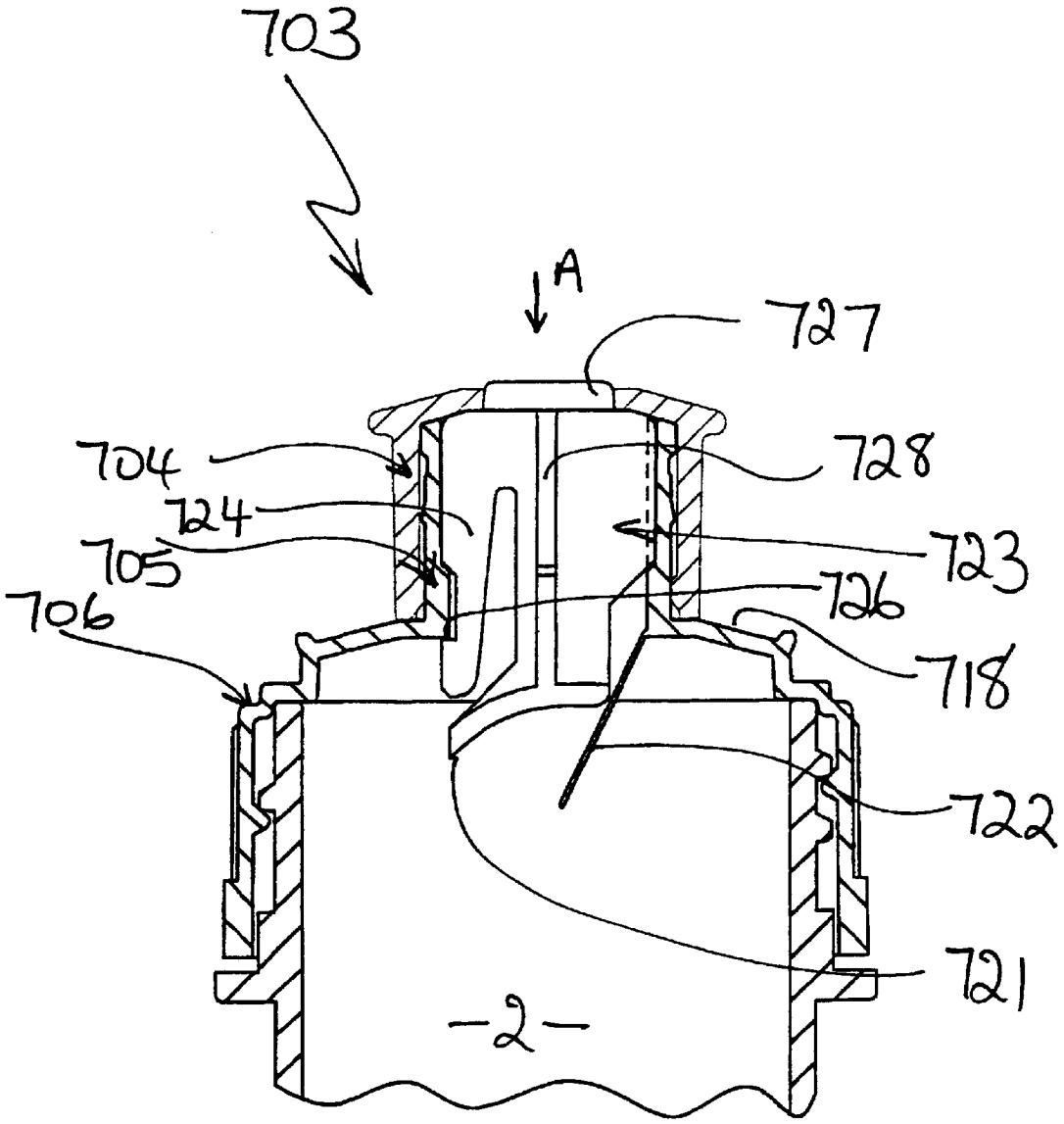
Figure 20:
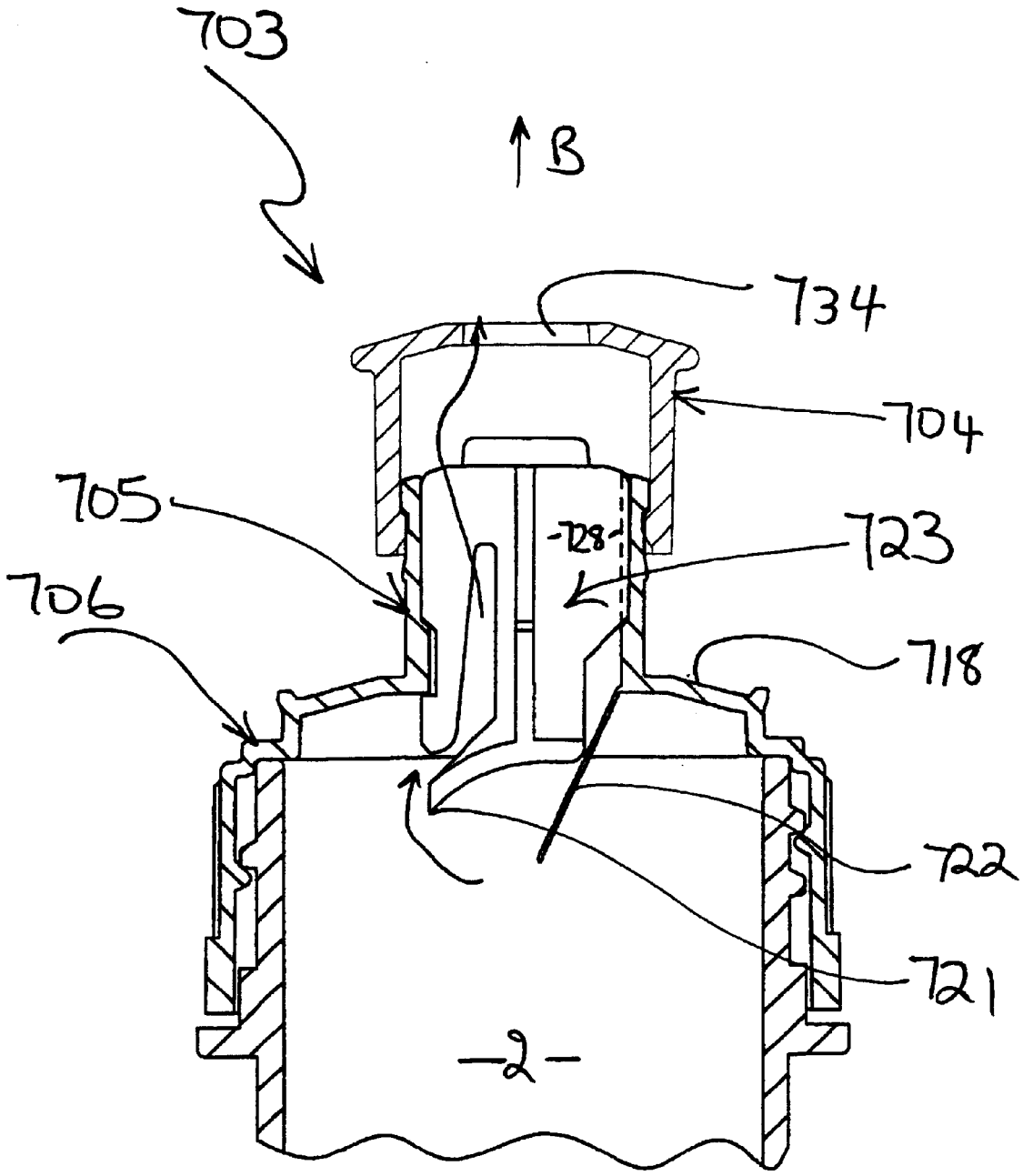

Referring to FIGS. 18–20, a seventh preferred embodiment of the cap 703 is there shown. The cover 4 fits about the cap 703 in the same manner as the cover 4 fits about the cap 103 of the first preferred embodiment. Projections, both outwardly and inwardly facing, being represented by numbers 108, 112, 110 and 111 from the first preferred embodiment, operate in the same manner when the top portion 704 is slid in a downward direction (arrow A FIG. 19), and in the upward direction (Figure B, FIG. 20) as is described for the first preferred embodiment.

In this embodiment the piercing point 721 is on an element which is a separate moveable portion 723 from both the top portion 704 and the neck portion 705. The seal 722 is of the same type as described in the first embodiment The moveable portion 723 includes at least one side flange 724 which, when the top portion 704 is in the initial position, is biased against the inside of the sides 715 of the neck portion 705. The moveable portion 723 is retained in the initial position shown in FIG. 18, and prevented from accidental downward movement, by an inwardly projecting flange element 725 of the side flange 724 on the inside face of the side 715 of the neck portion 705. The inwardly projecting flange element 725 may be completely annular about the inside of the sides 715 of the neck portion 705, or it may be an interrupted portion there around.

An upwardly facing projection 727 is positioned on the top of the moveable portion 723. This projection 727 engages with the hole 734 in the top of the top portion 704.

Thus tamper-evidence (or lack thereof) is visible if the moveable portion 723 and the top portion 704 are both in an elevated position, as shown in FIG. 18. If either portion (723, 704) is not in this elevated position, this can be visually seen through the clear plastic cover 4 (or in the absence of the cover) without the need to inspect any other tamper-evident means physically attached to the outside of the cap 703 and container 2.

Additional flanges 728 are provided, (so portion 723 is a cross in cross-section), between the projection 727 and the piercing point 721. These are shaped so as to provide a liquid passageway between the edges of the flanges 724, 725 and the projection 727 and the piercing point 721.

The above described embodiment of the cap 703 works in the following manner: the top 704 is pushed in a downward motion (arrow A FIG. 19) in the same manner as described for the first preferred embodiment. The curved portion 718 of the collar 706 arrests the downward motion of the top portion 704. As the top portion 704 is pushed downward this in turn pushes down the moveable portion 723 by engagement with the top projection 727. The piercing point 721 pushes the edge of the foil seal 722 aside. As the moveable portion 723 descends the lower edge of the flange 724 clears the lower edge of the neck portion 705 and flares outwards to its natural position. The projection 726 at the bottom end of the flange 724 then engages with the base of the curved portion 718 of the collar 706, retaining the moveable portion 723 in the lowered position. The projection 727, engaging with the hole 734, provides the liquid seal when the cap 703 is in the closed position.

Referring to FIG. 20, with the upward motion of the top portion 704 in the direction of arrow B, a liquid passage is created, as shown by arrows on FIG. 20. When the top portion 704 is pressed in the downward direction the projection 727 seats again in hole 734 sealing the liquid passageway (FIG. 19).

The embodiment shown in FIGS. 18–20 has one flange 724 which projects to engage with the bottom of the portion 718 the collar 706 when the moveable portion 723 is in the lower position. However it will be appreciated by those skilled in the art that flanges 728 may be of the same type as flange 724, rather than being a flange provided solely for rigidity and liquid passage.

In this embodiment the piercing point 721 is disclosed as being at the end of a curved lower portion of the moveable portion 723. However, it will be appreciated that the sides leading to the piercing point 721 may be formed from a straight section though the base of the moveable portion 723.

Figure 21:
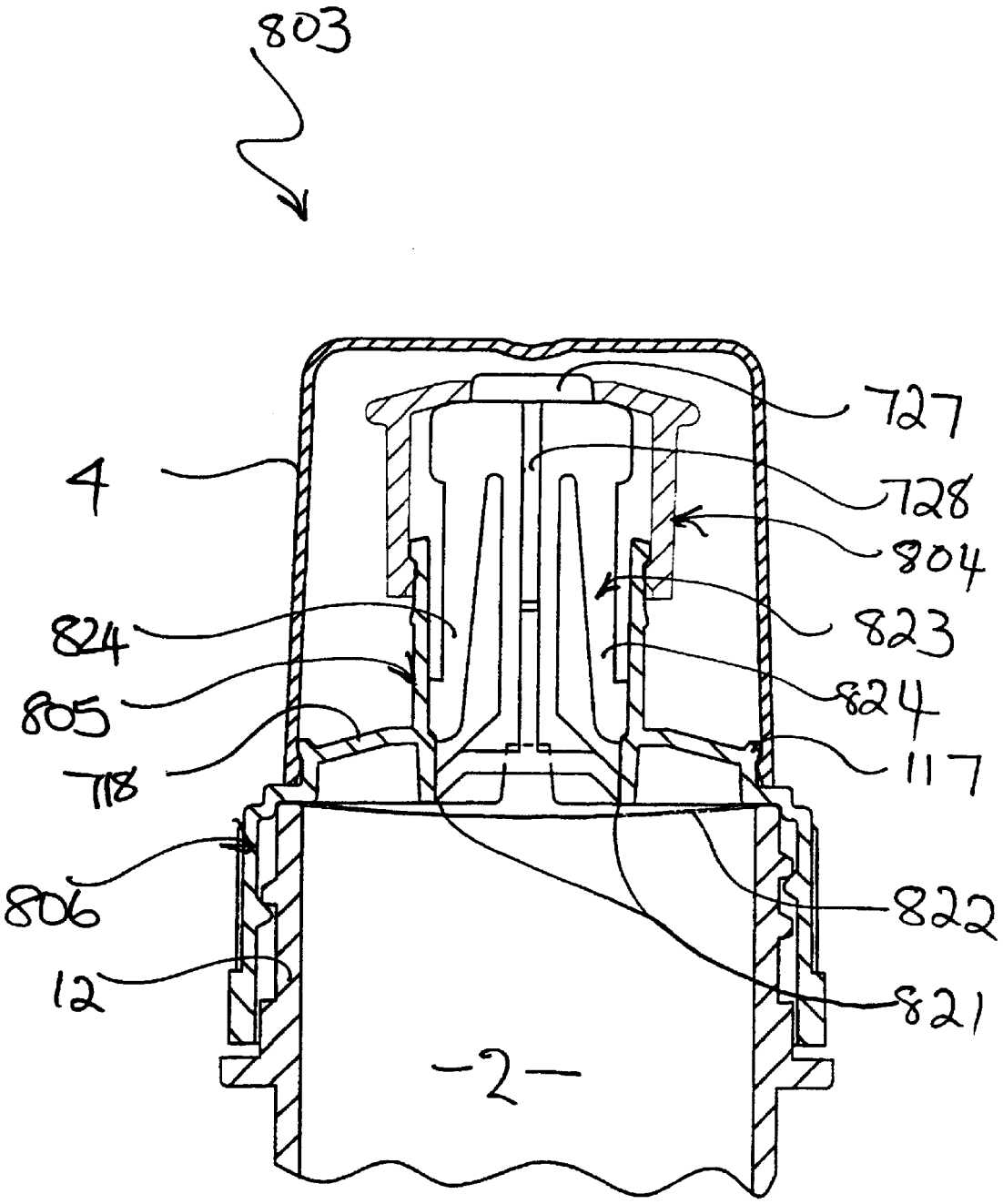
FIGS. 21–23 disclose an eighth preferred embodiment of the cap of the present invention in the same position as that shown in FIGS. 1, 2 and 3 respectively.
Figure 22:
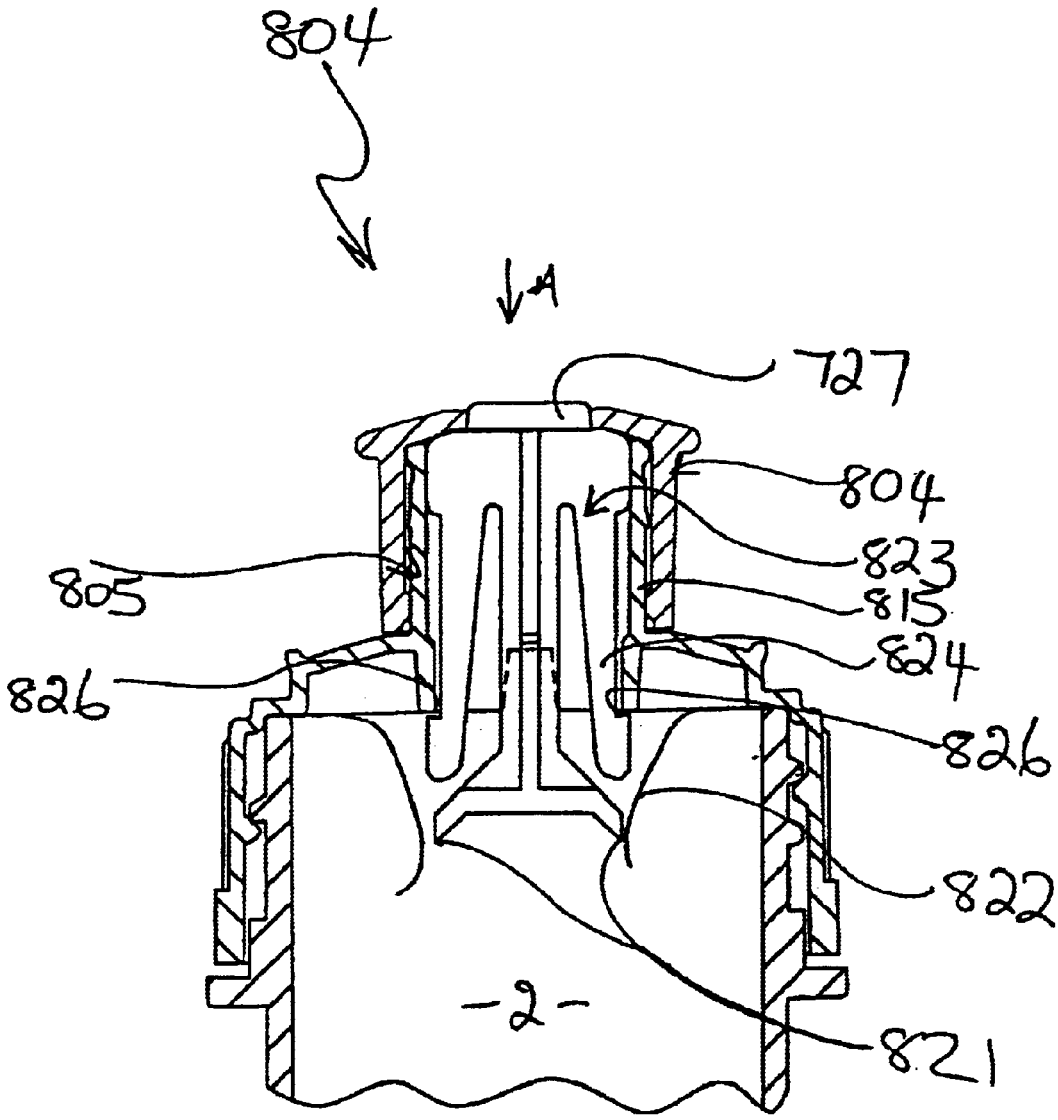
Figure 23:
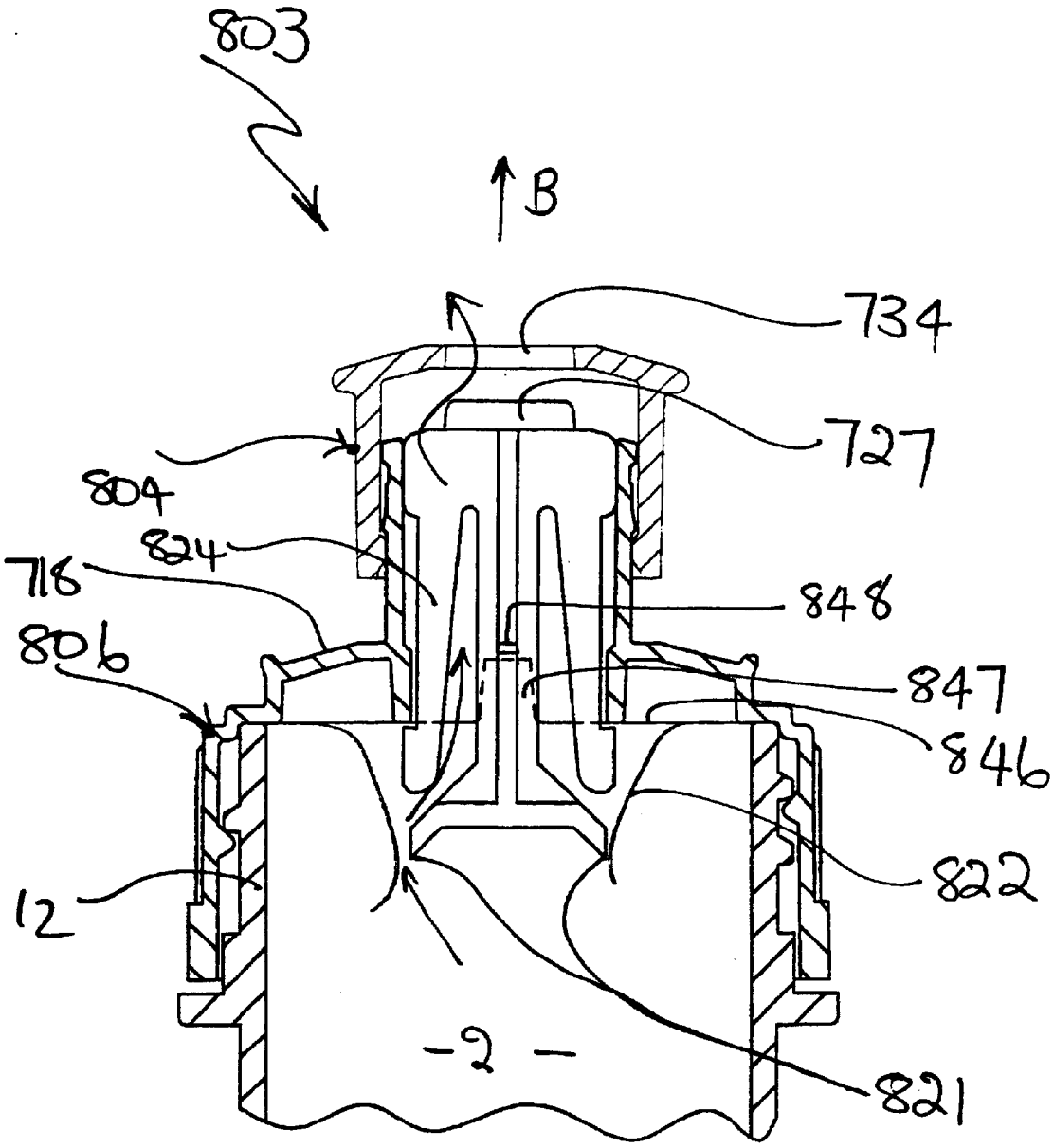

Referring to FIGS. 21–23 an eighth preferred embodiment of the present invention of the cap 803 is there shown. This cap 803 is otherwise identical with the seventh preferred embodiment of the cap. 703, except that the seal 822 is of the type that seals across the top of the container 2 rather than being formed integrally with the neck portion 805 and collar 806 of the cap 803.

The embodiment also includes two piercing points 821. It will be appreciated, however, that in all embodiments, except the fifth preferred embodiment, two or more piercing points may be peripherally located about the base of the piercing element, whether the element be present on the moveable portion (723, 823) or the top portion.

In this eighth embodiment, as the moveable portion 823 is forced downwardly (arrow A, FIG. 22) the two flanges 824 spring outwardly and bottom projection 826 engages with the bottom of the sides 815 of the neck portion 805. The liquid passageway provided, once the top portion 804 is moved back to the open position, is shown in FIG. 23. The arrows indicate the direction of motion of the liquid, past the projections 826 and broken seal 822, past the flanges 824 and through the openings beside the projections 727, through the hole 734 in the top 804 to the exterior of the container 2.

In this embodiment the collar 806 incorporates an internal flat flange 846 supporting an upward central projection 847. A projection 848 on the flanges 824 engage the central projection 848 to provide an additional stop for the downward motion of the moveable portion 823. The operation of the eighth embodiment 803 is otherwise as described for the seventh embodiment 703.

Figure 24:
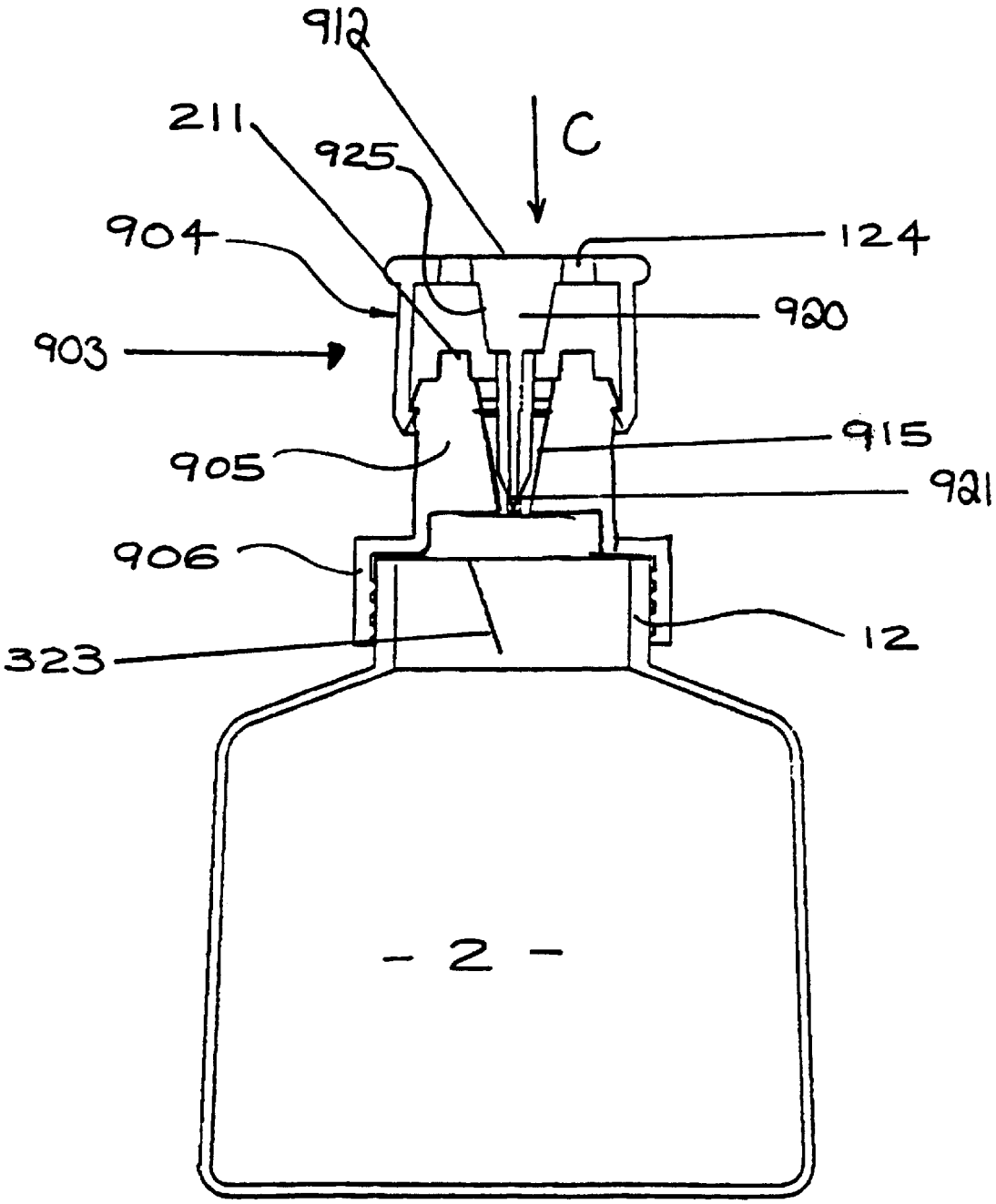
FIGS. 24–25 discloses a ninth preferred embodiment of the cap of the present invention in the same position as shown in the first embodiment in FIGS. 3 and 4.
Figure 25:
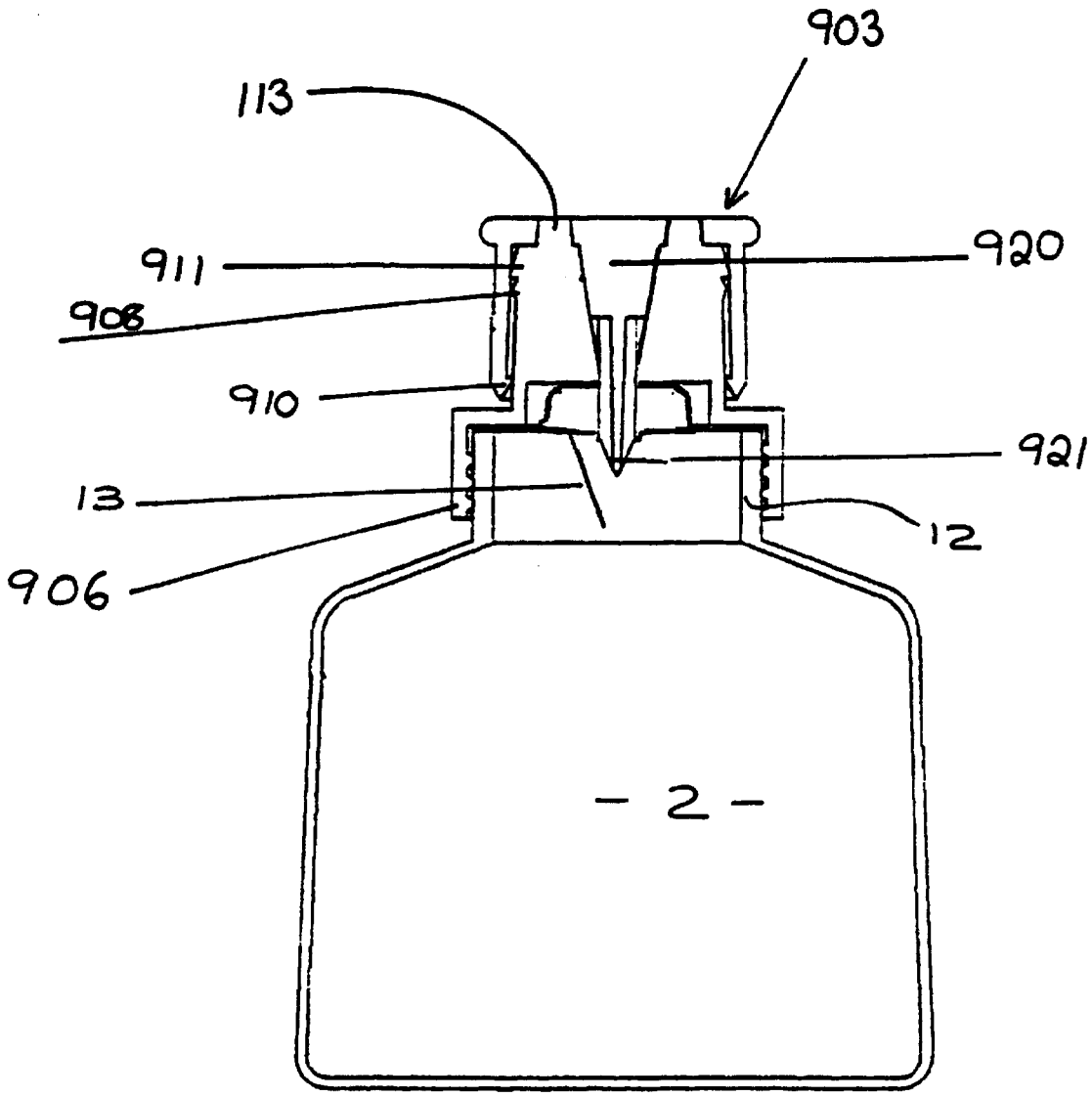

Referring to FIGS. 24 and 25, a ninth embodiment of the cap 903 is thereshown. In this embodiment the seal piercing means 921 is formed integrally with the top 904.

The top portion 912 with at least two holes 124 therethrough. The number of holes 124 may be increased up to four or more, as is desired. A downwardly facing prong 920 is formed integrally with the underside of the top portion 912. The prong 920 has a shaped tip 921 which may be sharpened, if so desired. As shown in FIG. 33 the prong 920 has a cross-section in the shape of a cross. Alternatively, if so desired, the prong 920 may have another cross-section, for example circular.

The neck portion 905 includes at least one shaped projection 211. The projections 211 are of a number and shaped in a manner complementary to the holes 124 in the top portion 904. Thus when the top portion 904 is in the closed position the projections 211 enter the holes 124 and form a liquid seal between the exterior of the container 2 and the exterior of the container 2. A liquid seal is also provided when the top portion 904 is in the closed position by the flange 925 of the top portion 904. This flange 925 bears against the interior sloping, circular side 915 of the neck portion 905. The flange 925 is in the shape of an inverted, truncated cone.

Figure 26:
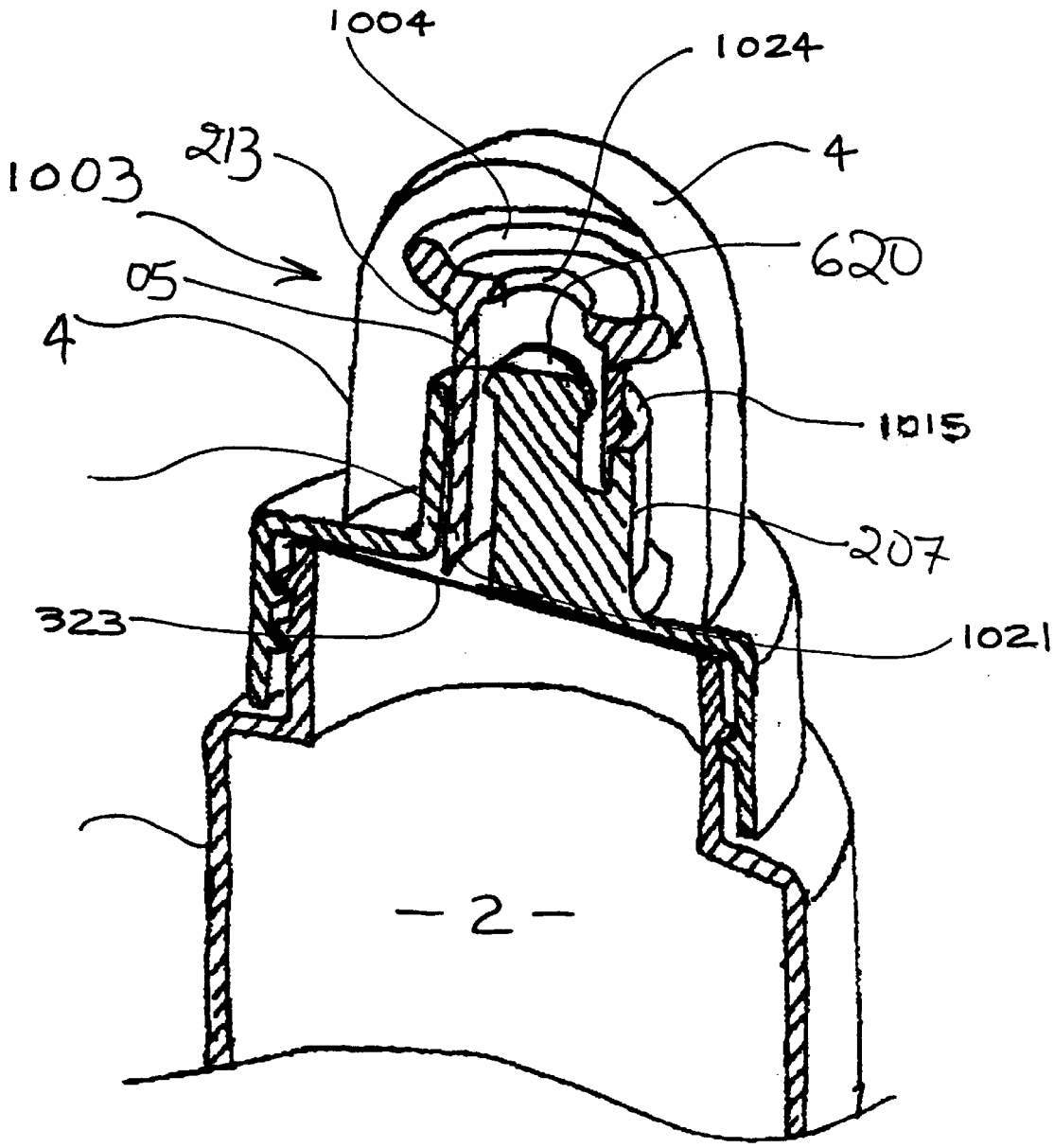
FIGS. 26–27 discloses a tenth preferred embodiment of the cap of the present invention in the same position as shown in the first embodiment in FIGS. 3 and 4.
Figure 27:
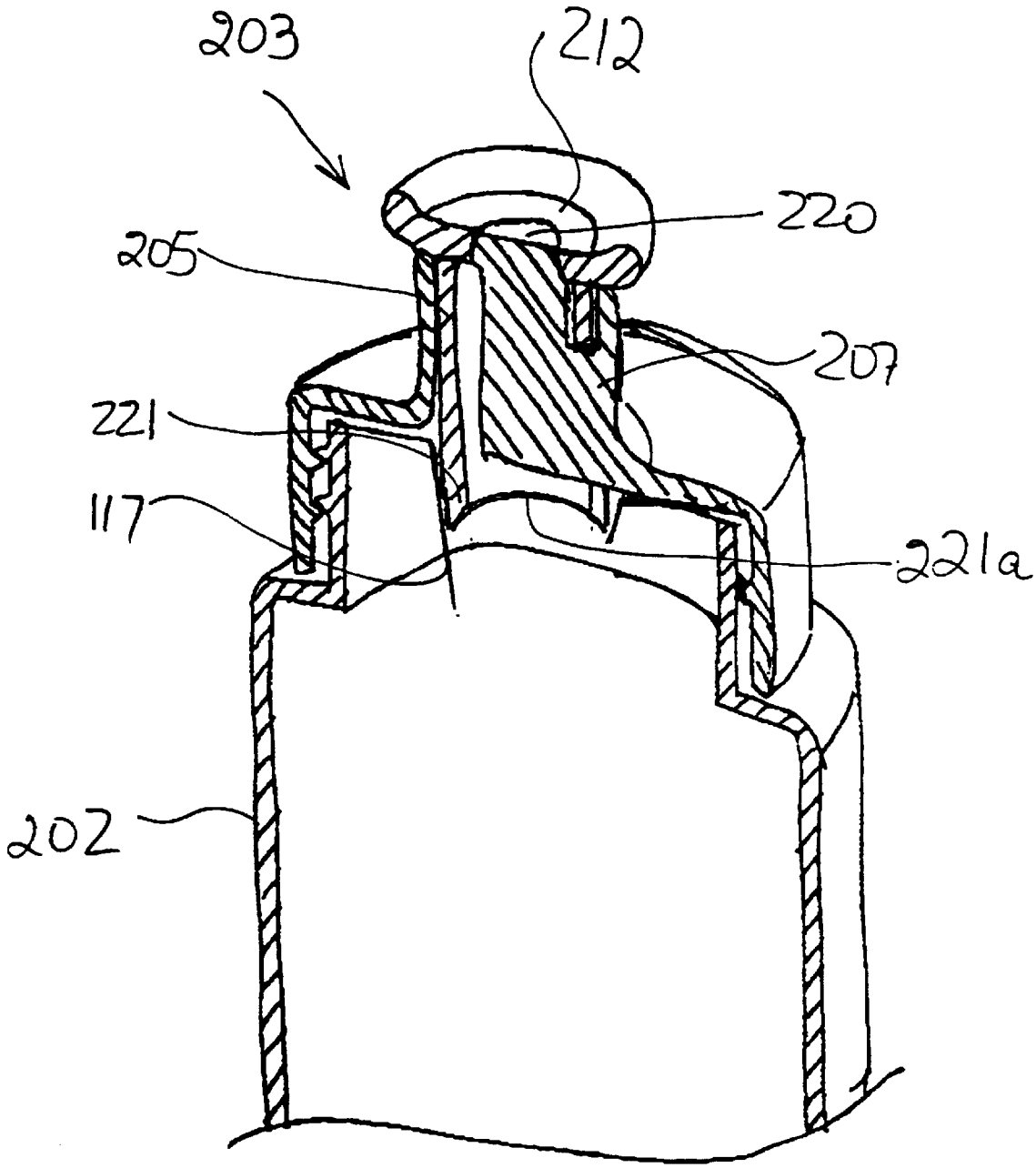

Referring to FIGS. 26 and 27 a tenth preferred embodiment of the cap 1003 of the present invention is thereshown. The top portion 1004 and the foil piercing means 1021 are formed integrally.

The mechanism of the opening and closing of the cap 1003 is the same as for the sixth embodiment of the invention (FIGS. 15–17), except that the point 1021 forms the lowest edge of the top portion 1004. The sides of the top portion 1004 are cut in an angular section sloping to the point 1021.

In both the ninth and tenth embodiments the cap (903, 1003) is in two parts, and the open position, like the seventh and eight embodiments of the cap (703, 803) is also the initial position of the top portion (904, 1004).

Figure 28:
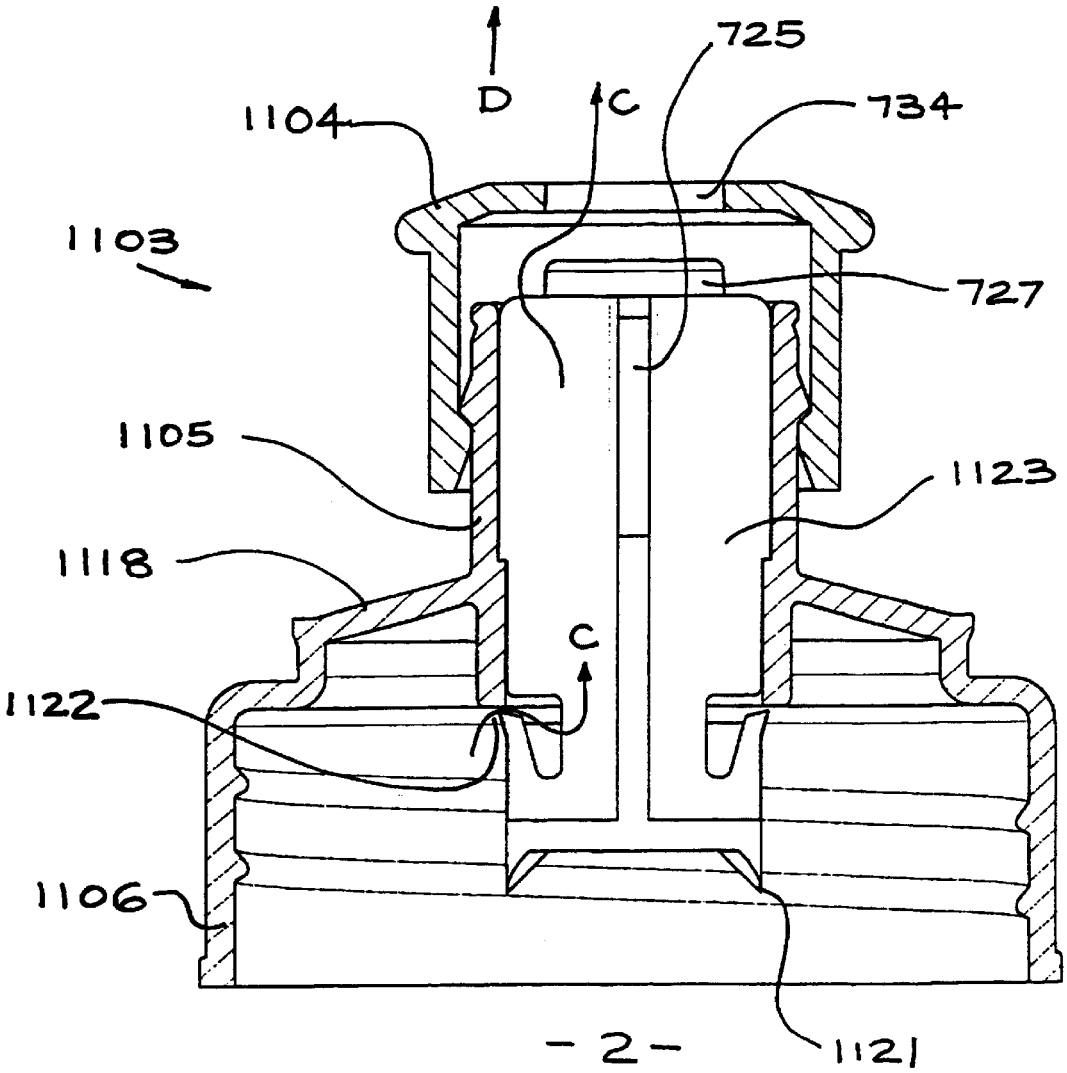
FIGS. 28–29 discloses an eleventh preferred embodiment of the cap of the present invention in the same position as shown in the first embodiment in FIGS. 3 and 4.
Figure 29:
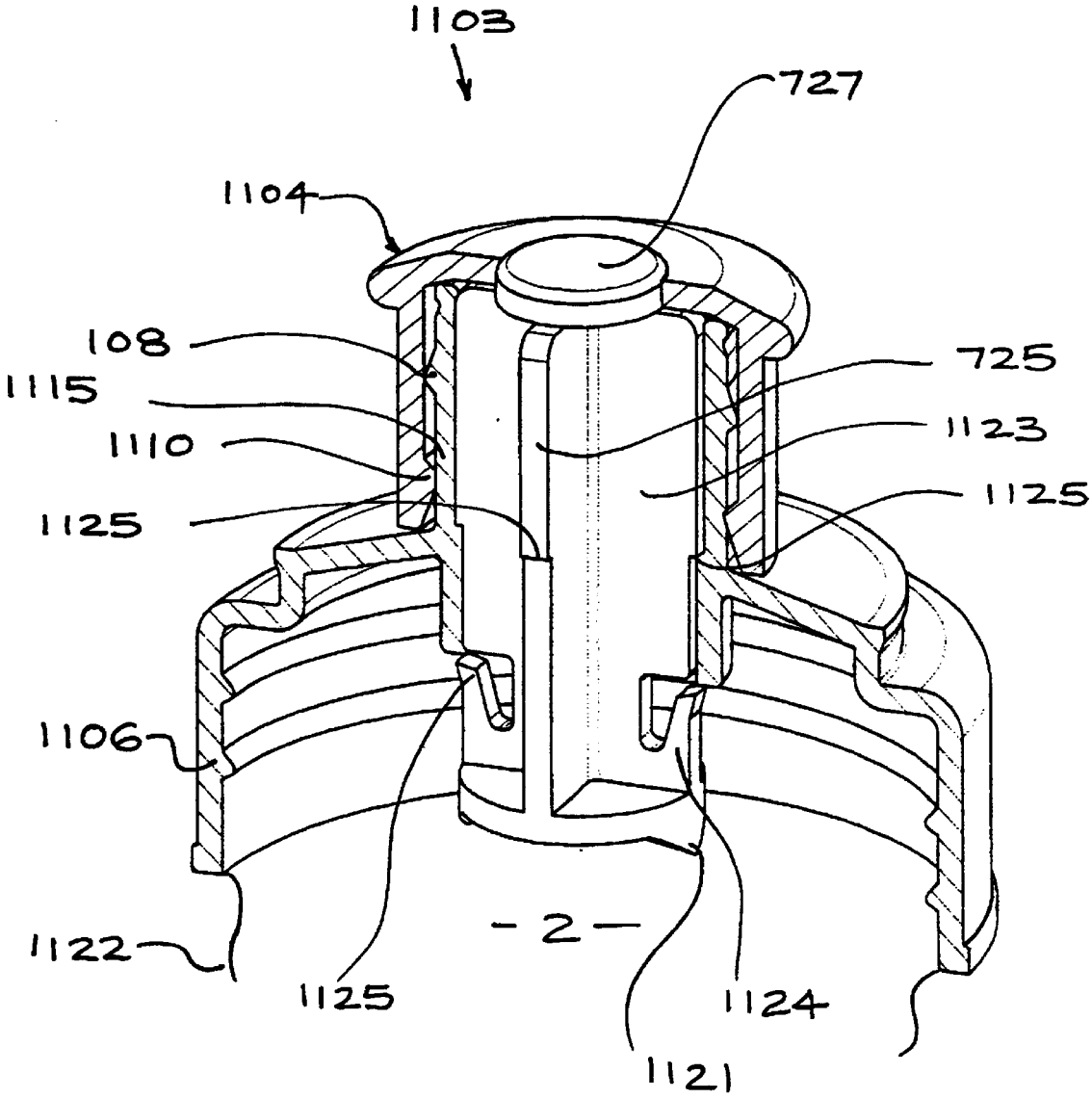

Referring to FIGS. 28 and 29 an eleventh preferred embodiment of the cap 1103 of the present invention is thereshown. The top portion 1104 and the foil piercing means 1121 are formed in two separate parts, as discussed for the seventh embodiment of the cap 703. The top portion 1104 has two positions, with the initial position being the same as the open position, as discussed above with various embodiments.

The projections 1124 are upwardly facing, being held within the sides 1115 of the neck portion 1105. When the top portion 1104 and moveable portion 1123 are pushed downward the projections 1124 spring outward as they clear the bottom of the sides 1115 of the neck portion 1105. The liquid passageway is created in the same manner as for the seventh embodiment of the cap 703.

The stop 1125 is dimensioned to be restrained from further downward movement by the shoulder on the sides 1115. The seal-breaking means comprises two downwardly facing projections 1121.

It will be appreciated by those skilled in the art that such seal-breaking means 114 may alternatively be selected from the following: two or more saw teeth, saw teeth forming the entire periphery of the seal-breaking projections 1121, saw teeth that are intermittent around the perimeter of the lowest part of the moveable portion 1124, a continuous edge around the perimeter of the lowest part of the moveable portion 1124 such as a curved knife, an intermittent knife around the perimeter, a prong or other downward projection at the centre of the seal-breaking means 114 (along the thrust axis of the inner portion); a flattened square cross section projection around the circumference or part thereof; and a combination of these.

Optionally the seal, regardless of the material, or the position, can include an area, line, curve or areas of weakness. These pre-weakened areas or lines are positioned such that the foil piercing means engages with these lines or areas as the foil piercing means begins to engage with the seal. The areas thus have reduced burst strength and will tear or rip in preference to any other area, thus providing that the seal will break cleanly and in the region of preference for use of the contents.

A number of different features in different embodiments have been described above. However it will be appreciated that these may be combined in varying ways and means (known to those skilled in the art) so that features can be selected out of one embodiment and added to features of another embodiment, without departing from the scope of the invention.

What is claimed is:

1. A cap for a container, said container having a top opening and being capable of containing a liquid, said cap incorporating a seal piercing element, and wherein:

the liquid in the container is initially separated from said piercing element by a seal; said cap including:

a collar with means for securing the cap to the container about the top opening, said collar being formed with a liquid passage therethrough;

a neck portion;

a top portion which is moveable, has a liquid passage therethrough, and comprises the seal piercing element; and wherein the top portion is moveable between three positions, these positions being an initial position, an open position and a closed position, the initial position being a visual indicator of a sealed container and wherein the top portion is moveable from the initial position to the closed position and, when first so moved, causes the piercing element to pierce the seal, and thereafter when said top is moved from the closed position to the open position a liquid passage way is created for the liquid from the container to outside the cap, and wherein thereafter when the top portion is in the closed position, one or more elements of the top portion bear against one or more elements of the neck portion, or engage therewith, to provide a liquid seal between the top portion and the neck portion;

and wherein said cap further includes:

releasable means for releasably maintaining the top portion in the initial position and releasable means for releasably retaining the top portion in the open position; and wherein when the top portion is in the initial position, the liquid is sealed within the container by said seal.

2. A cap for a container as claimed in claim 1 wherein the neck portion and the top portion are centrally located over the top opening of the container.

3. A cap for a container as claimed in claim 1 wherein the neck portion and the top portion are centrally located to one side of the centre line of the top opening of the container.

4. A cap for a container as claimed in claim 1 wherein said top portion and said piercing element are formed integrally.

5. A cap for a container as claimed in claim 1 wherein said seal is made from material selected from the group consisting of: aluminum foil; flexible plastics; rigid plastics; cardboard, wood, wood products; and a combination of these.

6. A cap for a container as claimed in claim 1 wherein said seal is secured to the top of the container, over the opening, after the liquid has been inserted into the container.

7. A cap for a container as claimed in claim 1 wherein said seal includes at least one area of predetermined weakness, with a burst strength lower than that of the remaining material of the seal.

8. A cap for a container as claimed in claim 1 wherein said top portion includes cylindrical side elements, which are positioned on the outside of a top part of the neck portion, wherein said side elements engage with the top part of the neck portion in a twisting or threaded motion, as said top portion is moved between the initial and the closed positions, and the closed and the open positions.

9. A cap for a container as claimed in claim 1 wherein said top portion includes cylindrical side elements, which are positioned on the inside of a top part of the neck portion, wherein said side elements engage with the top part of the neck portion in a twisting or threaded motion, as said top portion is moved between the initial and the closed positions, and the closed and the open positions.

10. A cap for a container as claimed in claim 1 wherein said neck portion includes a section of the liquid passageway therethrough in the shape of an inverted truncated conical section; and the top portion includes an exterior surface of a shape complimentary to said section, said surfaces bearing against each other when the cap is in the closed position to form a liquid seal therebetween.

11. A cap for a container as claimed in claim 1 wherein the liquid passageway through the top portion comprises at least one hole, each said hole engaging with an upward facing projection on the neck portion, each projection being of a complimentary shape.

12. A cap for a container as claimed in claim 1 wherein said piercing element is a separate element within said top portion, said piercing element being moveable between two positions: an upper position and a lower position, and wherein said upper position forms part of the initial position of the top portion, and wherein when said top portion is in the initial position and is moved to the closed position, said piercing element is pushed from the upper position to the lower position; and thereafter said piercing element is retained in said lower position.

13. A cap for a container as claimed in claim 1 wherein the neck portion and the collar are formed integrally.

14. A cap for a container as claimed in claim 13 wherein said seal is formed integrally with the collar.

15. A cap for a container as claimed in claim 1 wherein said piercing element is a separate element within said top portion, said piercing element being moveable between two positions: an upper position and a lower position, and wherein said upper position forms part of the initial position of the top portion, and wherein when said top portion is in the initial position and is moved to the closed position, said piercing element is pushed from the upper position to the lower position; and thereafter said piercing element is retained in said lower position.

16. A cap for a container as claimed in claim 15 wherein the liquid passageway through the top portion comprises one opening, the opening engaging with a projection formed on the top of the piercing element, said projection being of a complimentary shape, such that when the cap is in the closed position, the opening and the projection form a liquid seal therebetween.

17. A cap for a container as claimed in claim 1 wherein said cap further includes a cover over at least part of the cap, said cover being releasably securable to said cap.

18. A cap for a container as claimed in claim 17 wherein said cap further includes additional tamper evident means formed around the cover and at least part of the cap.

19. A cap for a container as claimed in claim 1 wherein said seal is formed integrally with the collar.

20. A cap for a container as claimed in claim 19 wherein said seal includes at least one area of predetermined weakness, with a burst strength lower than that of the remaining material of the seal.

21. A cap for a container as claimed in claim 19 wherein said top portion includes cylindrical side elements, which are positioned on the inside of a top part of the neck portion, wherein said side elements engage with the top part of the neck portion in a twisting or threaded motion, as said top portion is moved between the initial and the closed positions, and the closed and the open positions.

22. A cap for a container as claimed in claim 1 wherein the piercing element includes a piercing point which is selected from the group consisting of: at least one sharpened edge; at least one point; at least one sharpened point; and a combination of these.

23. A cap for a container as claimed in claim 22 wherein each said point and each said edge are peripherally positioned at the bottom of cylindrical sides of the top portion, said sides being formed with the liquid passageway therein and through.

24. A cap for a container as claimed in claim 23 wherein said bottom of said top portion is formed at an angle with reference to the sides of the top portion.

25. A resealable container which comprises:

a container with a top opening, which container is capable of containing a liquid; a seal; and a cap wherein:

the liquid in the container is initially separated from said piercing element by a seal; said cap including:

a collar with means for securing the cap to the container about the top opening, said collar being formed with a liquid passage therethrough;

a neck portion;

a top portion which is moveable, has a liquid passage therethrough, and comprises the seal piercing element; and wherein the top portion is moveable between three positions, these positions being an initial position, an open position and a closed position, the initial position being a visual indicator of a sealed container and wherein the top portion is moveable from the initial position to the closed position and, when first so moved, causes the piercing element to pierce the seal, and thereafter when said top is moved from the closed position to the open position a liquid passageway is created for the liquid from the container to outside the cap, and wherein thereafter when the top portion is in the closed position, one or more elements of the top portion bear against one or more elements of the neck portion, or engage therewith, to provide a liquid seal between the top portion and the neck portion;

and wherein said cap further includes:

releasable means for releasably maintaining the top portion in the initial position and releasable means for releasably retaining the top portion in the open position; and wherein when the top portion is in the initial position, the liquid is sealed within the container by said seal.

26. A resealable container as claimed in claim 25, said container further including a liquid.

27. A resealable container as claimed in claim 25 wherein the piercing element includes a piercing point which is selected from the group consisting of: at least one sharpened edge; at least one point; at least one sharpened point; and a combination of these.

28. A resealable container as claimed in claim 25 wherein the neck portion and the collar are formed integrally.

29. A resealable container as claimed in claim 25 wherein said piercing element is a separate element within said top portion, said piercing element being moveable between two positions: an upper position and a lower position, and wherein said upper position forms part of the initial position of the top portion, and wherein when said top portion is in the initial position and is moved to the closed position, said piercing element is pushed from the upper position to the lower position; and thereafter said piercing element is retained in said lower position.

30. A resealable container as claimed in claim 25 wherein said container further includes additional tamper evident means formed around the cover and at least part of the cap.

31. A resealable container as claimed in claim 25, said container further including a liquid suspension.

32. A resealable container as claimed in claim 25 wherein said seal is formed integrally with the collar.

33. A resealable container as claimed in claim 32, said container further including a liquid.

34. A resealable container as claimed in claim 32, said container further including a liquid suspension.

* * * * *